US010569400B2

(12) United States Patent
Wilson et al.

(10) Patent No.: US 10,569,400 B2
(45) Date of Patent: Feb. 25, 2020

(54) HAND TOOL FOR ASSEMBLING AND DISASSEMBLING ROLLER CHAIN

(71) Applicant: DEKA Products Limited Partnership, Manchester, NH (US)

(72) Inventors: Benjamin A. Wilson, Manchester, NH (US); Jason M. Overson, Manchester, NH (US); Jacob W. Scarpaci, Manchester, NH (US)

(73) Assignee: DEKA Products Limited Partnership, Manchester, NH (US)

( * ) Notice: Subject to any disclaimer, the term of this patent is extended or adjusted under 35 U.S.C. 154(b) by 143 days.

(21) Appl. No.: 15/473,793

(22) Filed: Mar. 30, 2017

(65) Prior Publication Data

US 2017/0282339 A1 Oct. 5, 2017

Related U.S. Application Data

(60) Provisional application No. 62/315,103, filed on Mar. 30, 2016.

(51) Int. Cl.
*B25B 27/22* (2006.01)

(52) U.S. Cl.
CPC ..... *B25B 27/22* (2013.01)

(58) Field of Classification Search
None
See application file for complete search history.

(56) References Cited

U.S. PATENT DOCUMENTS

| | | | | |
|---|---|---|---|---|
| 2,895,289 | A * | 7/1959 | Wognum | B25B 27/22 59/7 |
| 4,833,875 | A | 5/1989 | Buermann et al. | |
| 5,203,158 | A | 4/1993 | Bowers | |
| 6,748,637 | B2 | 6/2004 | Meggiolan | |
| 6,880,323 | B2 | 4/2005 | Coleman | |
| 6,988,288 | B2 * | 1/2006 | Wang | B25B 27/22 59/11 |
| 8,136,338 | B2 | 3/2012 | Huang | |
| 8,166,745 | B2 | 5/2012 | Seiter | |
| 2004/0250528 | A1 * | 12/2004 | Coleman | B25B 27/0071 59/84 |
| 2010/0307126 | A1 | 12/2010 | Seiter et al. | |
| 2011/0061360 | A1 | 3/2011 | Huang | |
| 2011/0179761 | A1 | 7/2011 | Yu | |
| 2013/0067708 | A1 | 3/2013 | Kuo | |

OTHER PUBLICATIONS

DarkSoul #25 Chain Breaker Tool—gg220, http://www.davesmotors.com/DarkSoul-25-Chain-Breaker-Tool-3466.html, page date 2018.
Modern Robotics Chain Break, https://modernroboticsinc.com/modern-robotics-chain-break, copyright 2019.
Tetrix Max Chain Breaker Tool, https://www.pitsco.com/TETRIX_Chain_Breaker_Tool/&TXredir=1, copyright 2019.

* cited by examiner

*Primary Examiner* — Brian D Keller
(74) *Attorney, Agent, or Firm* — Kathleen Chapman

(57) ABSTRACT

A hand tool for assembling and disassembling a work piece. The hand tool can be configured for assembling and disassembling a work piece having a plurality of linkable units. The hand tool can include a first work station where at least one assembling operation can be performed and a second work station where at least one disassembling operation can be performed.

9 Claims, 25 Drawing Sheets

HAND TOOL FOR ASSEMBLING AND DISASSEMBLING ROLLER CHAIN

CROSS REFERENCE TO RELATED APPLICATIONS

This application claims the benefit of U.S. Provisional Application Ser. No. 62/315,103 filed Mar. 30, 2016, entitled A HAND TOOL FOR ASSEMBLING AND DISASSEMBLING ROLLER CHAIN, which is incorporated herein by reference in its entirety.

BACKGROUND

The present teachings relate to a hand tool for assembling and disassembling a work piece. More specifically, the present teachings relate to a hand tool configured for assembling and disassembling a work piece comprising plurality of linkable units. The hand tool further comprises a first work station where at least one assembling operation can be performed and a second work station where at least one disassembling operation can be performed.

One of the most fundamental and largely used mechanical forms of engagement is a linkage. Positioning of the linkages and number of linkages in an equipment can govern movement and force transmission within and/or by the equipment. Depending on a desired operation, a linkage or a plurality of linkages can provide a calculated operational freedom to the equipment or part of the equipment. The operational freedom can be in the form of a structural flexibility and/or at least one desired motion such as, but not limited to, sliding motion, pivotal motion, rotational motion, linear motion or linear motion along a pre-determined path and/or a combination thereof. In some equipment/s, the linkages can simply support two or more parts without directly participating in the operation. Typically, a linkage formation involves at least two distinct linkable units with node/s, where the linkage is achieved, and at least one coupling element that complements the nodes to complete the linkage. In some equipment, the at least two distinct linkable units can couple features integral to them and eliminate the need of an external coupling element.

A number of nodes on a linkable unit can be utilized to categorize the linkage, e.g. a binary linkage comprises two nodes, a tertiary linkage comprises three nodes, a quaternary linkage comprises four nodes and so on. The present disclosure relates to binary linkages and their formation. Binary linkages are most common in equipments that involve a series of linkages that are recurring and can optionally be of an identical or similar nature. In most cases, equipments with series of recurring linkages involve the linkages to define and/or extend along a length of the equipment. Each participating unit in the linkages can involve at least one end that forms a linkage and a second end that can be constrained in a pre-determined manner or can participate in forming an adjacent linkage. Such equipments serve well in transmission of mechanical power from one point to another point. On example of this type of transmission can be a drive chain in a bicycle or a like device that serves to transmit mechanical power from the pedals to a drive wheel that is essentially engaged with the wheels of the bicycle by way of a chain.

Chains are often used for mechanical power transmissions in a variety of devices that can range from toys, electromechanical robots, motorized or non-motorized vehicles, assembly lines of an industrial and/or manufacturing environment, travelators, escalators, or similar settings that require mechanical energy to be transferred from one point to another. Settings as discussed above or similar to these require robust chain drives that are further capable of advancing the necessary mechanical energy from its source to at least one destination. The employed chain/s are further required to sustain complete or partial load of the driving unit/s and the driven unit/s. Another significant feature is the ability to easily replace worn out links or parts of the chain and/or resize the chain as per the motive/s of the setting. These features can be highly dependent on the nature of the linkable units that form the chain. Some examples of chain links are, but not limited to, torus shaped links that usually appear as a rope, maillo-type link that comprise a threaded sleeve that tightens over a thread to complete the link or a series of carabiners.

Roller chain has been widely used in automotive equipments. A roller chain typically comprises a series of inner links that are engaged using a series of outer links. Engagement between an inner link and an outer link is achieved through a pin that is inserted into a pin housing that is formed collectively by aligning a bushing belonging to the inner link and pin holes of the mating outer link. This engagement continues to occur along the length of roller chain. Resizing a roller chain or replacement of an outer link or an inner link can be done by withdrawing the pin from an identified link, removing the link or adding a new links, and subsequently inserting the pin into an empty pin housing. A conventional method of removing the pin is to hammer the pin out of the identified link. Similarly, insertion of the pin was achieved by aligning the mating links and hammering the pin into the pin housing. A variety of chain tools have been devised for convenient removal and insertion of the pin.

Currently-used chain tools provide a fragile mechanism of locking a segment of the roller chain from where the pin is to be withdrawn. A user of the current chain tools is usually required to hold onto the target link or a part of the target link to ensure that the roller chain is not displaced while removing the pin. A driver screw or a guide is typically used to interact with the target pin to drive the pin out of the identified link. Dimensional restrictions of the pin can lead to miss-alignment between the screw end that drives the pin and the pin itself, thus making it difficult for a user to exclusively operate the chain tool. Moreover, it is a struggle for the current chain tools to align a completely removed pin back into a potential link, and to stop the pin from exiting the chain assembly when attempting an assembling operation. There stands a need of a chain-tool that can be equipped to deal with the above discussed issues and can be easily operated by minors and adults of all age groups. The present application discloses a chain tool of said nature.

SUMMARY

The hand tool of one configuration of the present teachings can include components such as, but not limited to, a prime body, a first door, a second door and a manipulator. In one configuration, the prime body can comprise a first work station and a second work station that can be coupled by a bridging wall. The first work station can further comprise a first operative channel, and the second work station can comprise a second operative channel. The first and the second operative channels can include a first opening and a second opening, each. The first work station can be committed to a disassembling operation while the second work station can be committed to an assembling operation. In another configuration of prime body, the first work station and second work station can perform both disassembling and/or assembling operations.

The hand tool can further comprise a first repository that can be positioned to comprise the first opening of the first operative channel and a second repository that can be positioned to comprise the first opening of the second operative channel. The first and the second repositories can further comprise at least one wall and a base to receive at least one work piece on which an assembling and/or a disassembling operation can be performed. The work piece can comprise a plurality of linkable units that can comprise at least one interior linkable unit and at least one exterior linkable unit that can be engaged using a pin. The pin can be received into pin housings provided on the interior and the exterior linkable units. The exterior linkable unit can comprise at least one pin hole while the interior linkable unit can comprise a pin receptacle for this purpose. A single linkage in the work piece can comprise a first exterior linkable unit and a second exterior linkable unit, configured to capture an interior linkable unit there between such that a first end of the inserted pin protrudes from a pin hole of the first exterior linkable unit and a second end of the pin extends from a second pin hole of the second exterior linkable unit. The linkable units can be aligned such that at least one pin hole of an exterior linkable unit can coincide with a pin receptacle of interior linkable unit.

In one configuration of the hand tool, the at least one wall and base of the first repository and the second repository can comprise assistive features to ensure retaining of the at least one work piece in an appropriate configuration when an operation is performed thereupon. In some configurations, these assistive features in combination with matching assistive features provided in the first and second repository and/or on the supplementary components that form the hand tool, can contribute in retaining and aligning the work pieces therein. Some examples of the assistive features can be, but not limited to contours on walls and/or base of the repositories, indents that can be provides on the repositories, to receive one or more parts of the work piece/s.

In one configuration of the present disclosure, the first door and the second door can be configured to manage access to the first operative channel and the second operative channel, respectively. The first door and the second door can be positioned opposing each other and can further comprise the matching assistive features to participate in trapping the work pieces/s in the first repository and/or the second repository. In one configuration, the first door and the second door each can be segmented into a first door segment and a second door segment. Each segment of the first door and the second door can be dedicated to a specific opening of the first operative channel or the second operative channel. Prime body can further comprise a first door platform configured to surround the first opening of the first operative channel and the first opening of the second operative channel. The first door can be in a locked-position when resting on the first platform, such that the first door segment of the first door can prevent access to the first opening of the first operative channel and the second door segment of the first door can prevent access to the first opening of the second operative channel.

The prime body can further comprise a second platform configured to include second opening of the first operative channel and second opening of the second operative channel. The second door can be in a locked position when the second door rests on the second platform, such that the first door segment of the second door can control access to the second opening of the first operative channel and the second door segment of the second door can prevent access to the second opening of the second operative channel. In some configurations of the present disclosure, the first door and the second door can be engaged with the prime body by way of connectors such as, but not limited to, fasteners. At least one connector can be configured to be inserted into a corresponding first connector point on the first door, a connector pathway on the prime body and a second connector point of the second door, to engage the first door, the prime body and the second door. Access to the first operative channel and/or the second operative channel can be provided by removal of one or more connectors causing the first door and the second door to displace from a locked position to an open position.

In another configuration of the hand tool, a connector can be configured to engage the first door, the prime body and the second door such that the first door and the second door can move relative to each other. The connector can be positioned in a connector sleeve that can be provided in the bridging wall. The connector can continue to retain its linear and rotational freedom of motions when placed in the connector sleeve. The first door can be engaged at a first terminal end of the connector and the second door can be engaged at the second terminal end of the connector. The first door can rotatably pivot about the first terminal end to switch from a locked position to an open position. The second door can be engaged with the second terminal of the connector such that rotation of the second door can cause the connector to rotate. In some configurations, rotation of the second door can influence rotational freedom of the first door.

The hand tool can further comprise a manipulator for performing a disassembling or an assembling operation. The manipulator can further comprise a handle portion and an insert portion. The insert portion can be configured to enter first operative channel through a first access window and the second operative channel through a second access window. The first access window and the second access window can be provided on the second door. The insert portion can further include a pin segment for contacting a target pin during a disassembling operation and for contacting an assembling pin during an assembling operation.

At least one work piece with a target link can be received into a first repository to accommodate a first end of the target pin at the first opening of the first operative channel and a second end of the target pin accommodated at an outlet provided on the first segment of the first door. Neighboring pins of the target pin can be rested such that first ends of the neighboring pins occupy a first set of indents on the base of the first repository and second ends of the neighboring pins occupy a second set of indents on the first door segment of the first door. Insert portion of the manipulator can be inserted through the first access window of the second door to enter the first operative channel through the second opening of the first operative channel. Pin segment of the insert portion can travel along the first operative channel to reach the first opening of the first operative channel and thereby contact the target pin. An external force can be applied through manipulator to allow the pin segment to push the target pin from target linkage for disassembling the work piece. The target pin can be eliminated through the outlet on the first door segment of the first door.

A first work piece with at least one unengaged interior linkable unit and a second work piece with at least one unengaged exterior linkable unit can be received in the second repository of the hand tool. Pin hole of the at least one unengaged exterior linkable unit and pin receptacle of the at least one unengaged interior linkable unit can be aligned using alignment features of the present teachings to form a potential link that can be further positioned on a first opening of the second operative channel. Neighboring pins of the potential link can be rested such that first ends of the neighboring pins occupy a first set of indents on the base of the second repository and second ends of the neighboring pins occupy a second set of indents on the second door segment of the first door. First door can be configured to be in a locked position by completely occupying the first door platform. An assembling pin can be inserted in to the second operative channel. The assembling pin can travel the second operative channel and reach the first opening of the second operative channel.

Insert portion of the manipulator can be inserted through the second access window of the second door to enter the second operative channel through the second opening thereof. Pin segment of the insert portion can travel along the second operative channel to reach the inserted assembling pin therein. An external force can be applied through manipulator to allow the pin segment to push the assembling pin into the potential link to couple the at least one unengaged interior linkable unit and the at least one unengaged interior linkable unit.

A method of the present teachings for removing a pin from a work piece using a hand tool can include, but is not limited to including, cradling the work piece in at least one work piece cradle. The work piece can include at least one pin. The method can further include aligning the work piece in the work piece cradle according to at least one alignment feature of the hand tool. The method can still further include locking, by the hand tool, the work piece in the work piece cradle, applying pressure to the pin through the at least one channel of the hand tool, and removing the pin from the hand tool.

A method of the present teachings for connecting, using a hand tool, a first link to a second link of a work piece using a pin can include, but is not limited to including, aligning the first link with the second link in a work piece cradle of the hand tool. The work piece cradle can include recesses that can accommodate protrusions in the work piece. The method can further include locking, using the hand tool, the aligned first link and the aligned second link in the work piece cradle, and inserting the pin in a channel of the hand tool. The method can further include receiving, by the pin, pressure applied to the pin through the at least one channel, and connecting, using the hand tool, the first link to the second link.

A method of the present teachings for modifying a work piece using a hand tool, where the hand tool can include at least one repository having at least one channel, at least one door having at least one outlet, and at least one manipulator, and where the work piece can include at least one pin, can include, but is not limited to including, cradling the work piece in the at least one repository, aligning the pin with the at least one channel, locking the work piece in the at least one repository using, at least, the at least one door, applying pressure, by the at least one manipulator, to the pin, the pressure pushing the pin through the at least one channel, and disassembling the work piece by moving the pin, by the at least one manipulator, through the at least one outlet. The method can optionally include forcing the at least one manipulator by an insert portion, the insert portion being threaded, retaining the at least one work piece in the at least one repository by at least one retaining feature accommodating at least one protrusion on the work piece, and rotating the at least one door up to blocking features in the at least one door.

A method of the present teachings for assembling a work piece using a hand tool, where the hand tool can include at least one repository, at least one channel, at least one manipulator, and at least one barrier, and where the work piece can include at least a first link, a second link, and a pin, can include, but is not limited to including, aligning the first link with the second link in the at least one repository, locking the aligned first link and the aligned second link in the at least one repository, inserting the pin in the at least one channel, and assembling the work piece by applying pressure, using the at least one manipulator, to the pin. The pressure can move the pin through the at least one channel, the first link, and the second link, and the pin can be blocked from travel by the at least one barrier.

A hand tool of the present teachings for modifying a work piece, where the work piece can include at least one pin channel, can include, but is not limited to including, at least one repository having at least one channel. The at least one repository can cradle the work piece in the at least one repository, and the at least one repository can align the at least one pin channel with the at least one channel. The hand tool can include at least one door having at least one outlet. The at least one door can lock the work piece in the at least one repository. The hand tool can include at least one manipulator that can apply pressure to at least one pin. The pressure can modify the work piece by pushing the at least one pin through the at least one channel. The work piece can optionally include an interior link and an exterior link, where the at least one pin can operably couple the interior link with the exterior link. The hand tool can optionally separate the interior link from the exterior link by including at least one outlet that can allow the at least one pin to exit the at least one pin channel. The hand tool can optionally operably coupling the interior link with the exterior link by including at least one barrier that can allow the at least one pin to remain in the at least one pin channel. The hand tool can optionally include an insert portion that can be operably coupled with the at least one manipulator, and can enable the applying of pressure to the at least one pin. The insert portion can optionally include threading. The hand tool can optionally include at least one retaining feature retaining the at least one work piece in the at least one repository. The at least one retaining feature can accommodate at least one protrusion on the work piece. The at least one retaining feature can include at least one contour and at least one pin indent, and the at least one contour can accommodate the interior links and the exterior links. The hand tool can optionally include at least one blocking feature inhibiting rotation of the at least one door, and at least one door platform providing a resting position for the at least one door. The at least one door can include a first segment that can include at least one outlet allowing the at least one pin to exit the at least one pin channel. The interior link can be separated from the exterior link when the at least one pin exits the at least one pin channel. The at least one door can include a second segment that can include at least one barrier. The at least one barrier can allow the at least one pin to remain in the at least one pin channel. The at least one barrier can enable operable coupling between the interior link and the exterior link. The first segment and the second segment can include a common junction. The common junction can include a connector hole. The connector hole can receive a connector, and the connector can rotatably couple a first of the at least one door with a second of the at least one door. The first at least one door and the second at least one door can surround the at least one repository and the at least one channel.

A hand tool of the present teachings for assembling a work piece, where the work piece can include at least a first link, a second link, and a pin, can include, but is not limited to including, at least one repository that can align the first link with the second link. The aligned first link and the aligned second link can be trapped in the at least one repository. The hand tool can include at least one channel that can accept the at least one pin, at least one manipulator that can apply pressure against the at least one pin, the pressure forcing the at least one pin through the at least one channel, the aligned first link, and the aligned second link, and at least one barrier blocking travel of the at least one pin.

A hand tool of the present teachings for assembling and disassembling a work piece can include, but is not limited to including, a body that can be divided into a first work station and a second work station. The first work station and the second work station can be operably coupled by a bridging wall. The first work station can include at least one first operative channel, and the second work station can include at least one second operative channel. The first operative channel can include a first operative channel first opening and a first operative channel second opening, and the second operative channel can include a second operative channel first opening and a second operative channel second opening. The hand tool can include a first door and a second door. At least one disassembling operation can be performed at first work station and at least one assembling operation can be performed at second work station. The first door can optionally manage access to the first operative channel and the second operative channel. The first door can optionally be operably coupled with the body by at least one door connector. A first repository of the first work station can optionally be positioned at an entrance of the first operative channel. A second repository of the second work station can optionally be positioned at an entrance of the second operative channel. The first repository and the second repository can optionally be configured to receive at least one work piece. The second door can optionally manage access to the first operative channel second opening and second operative channel second opening. The second door can optionally include a first access window and a second access window. The first access window can optionally provide access to the first operative channel. The second access window can optionally provide access to the second operative channel. The first access window and the second access window can optionally allow an operative tool to enter the first operative channel and the second operative channel. The first door and the second door can optionally be engaged with the body through connectors. The operative tool can include a first manipulator enabling disassembly of the work piece, and a second manipulator enabling assembly of the work piece. The operative tool can include a common manipulator enabling assembly and disassembly of the work piece.

BRIEF DESCRIPTION OF THE DRAWINGS

These and other aspects will be more apparent from the following detailed description of the various configurations of the present disclosure with reference to the drawings wherein.

DETAILED DESCRIPTION

Figure 1A:
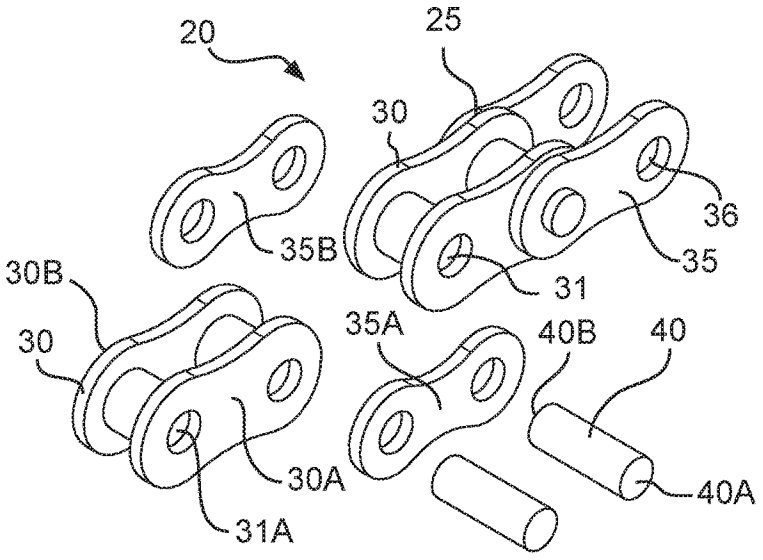
FIGS. 1A-1D depict perspective views of an exemplary work piece on which an assembling and/or disassembling operation can be performed.
Figure 1B:
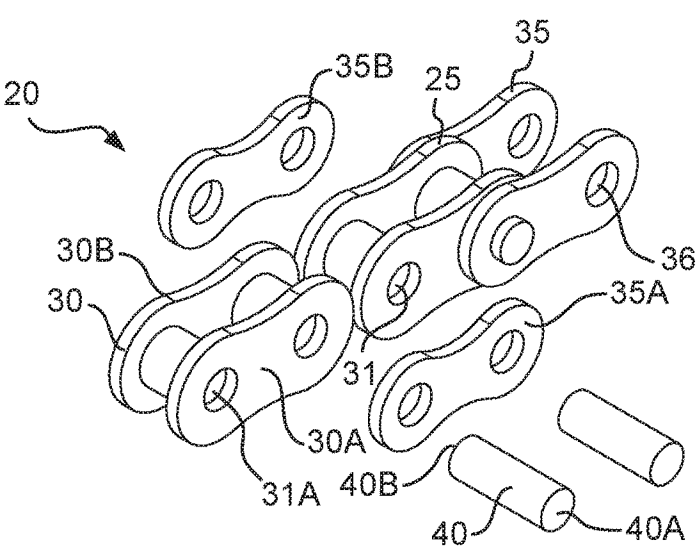

Referring now to FIGS. 1A-1D, exemplary work piece 20 can include, but is not limited to including, a series of linkages 25 formed from a plurality of linkable units. The linkages 25 can be formed by interaction of at least one interior linkable unit 30 and at least one exterior linkable unit 35. For the present disclosure, an example of work piece 20 can be, but not limited to, a chain such as a roller chain, a ladder, a belt or similar structures with a plurality of binary linkages wherein the nature of the linkage can be recurring along a length of the structure. At least one interior linkable unit 30 and at least one exterior linkable unit 35 can be engaged by way of a pin 40. Pin 40 can be, but not limited to being a pin like structure, that can be dimensioned to enter complementing pin housings that can be provided by the interior linkable unit 30 and the exterior linkable unit 35 for receiving and retaining pin 40. The interior linkable unit 30 can comprise a first inner link plate 30A and a second inner link plate 30B. The first inner link plate 30A and the second inner link plate 30B can be engaged by way of at least one connecting element that can also serve as a receptacle for pin 40. The at least one connecting element can be hereinafter referred to as pin receptacle 31. In some configurations, the pin receptacle 31 can be a cylindrical housing between the first inner plate 30A and the second inner plate 30B, such as, but not limited to including a bushing. In some configurations, pin 40 can be received by a bushing (not shown) before entering the corresponding housings of the exterior linkable units 35 and the interior linkable unit 30. A first opening 31A of the pin receptacle 31 can be provided on the first plate 30A and a second opening 31B (not shown) of the pin receptacle 31 can be provided on the second plate 30B of the interior linkable unit 30.

Continuing to refer to FIGS. 1A-1D, wherein the exterior linkable unit 35 of work piece 20 can further comprise at least one pin hole 36. The interior linkable unit 30 and the exterior linkable unit 35 can be disposed such that the pin receptacle 31 of the interior linkable unit 30 and a corresponding pin hole 36 of the exterior linkable unit 35 can be aligned to receive pin 40. The pin 40 can further comprise a first pin-end 40A and a second pin-end 40B. Insertion of the pin 40 can be achieved by inserting pin-end 40B into pin hole 36 of a first exterior linkable unit 35A, followed by progression of pin end 40B into the first opening 31A of the pin receptacle 31. Progression of pin end 40B can be caused due to alignment between the first opening 31A and the earlier mentioned pin hole 36 of first exterior linkable unit 35A. Pin end 40B can depart the pin receptacle 31 through the second opening (not shown) and consequently enter pin hole 36 of a second exterior linkable unit 35B. As a result, the pin 40 can be retained in pin hole 36 of the first exterior linkable unit 35A, pin receptacle 31 of interior linkable unit 30 and a second pin hole 36 of the second exterior linkable unit 35B. Consequently, at least one interior linkable unit 30 can be partially sandwiched between first exterior linkable unit 35A and second exterior linkable unit 35B. Additionally, such an engagement can cause the first plate 30A of interior linkable unit 30, to be in contact with the first exterior linkable unit 35A and the second plate 30B of interior linkable unit 30 to be in contact with the second exterior linkable unit 35B.

Figure 2:
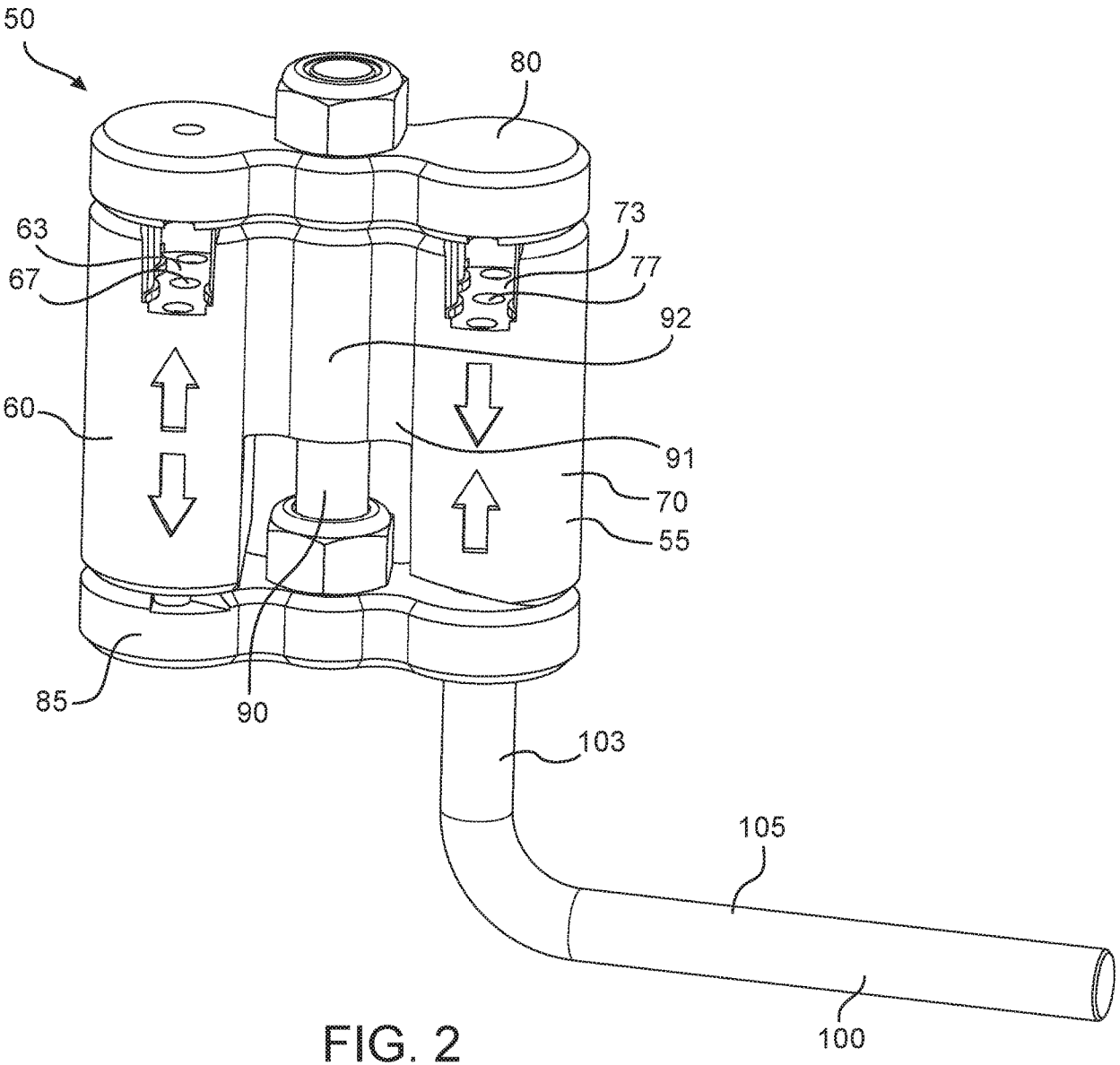
FIG. 2 depicts a perspective view of a first hand tool configuration.

Referring now to FIG. 2 that depicts a first exemplary configuration of hand tool 50 which further comprises a prime body 55, first door 80 and second door 85. The first door 80 and second door 85 can be configured to provide access to operative areas of prime body 55. Dimensions of hand tool 50 can contribute in providing a portability feature along with convenience in handling the hand tool 50 by a sole user. In some configurations, hand tool 50 can be a metallic or a non-metallic structure. In some configurations, hand tool 50 can be made from materials such as, for example, but not limited to, engineering plastics, for example, but not limited to, acrylonitrile butadiene styrene, acetal, delrin, hydex, nylon, polycarbonate, polyurethane and polyethylene terephtalate, etc. In some configurations of hand tool 50 can be manufactured from commodity plastics such as, but not limited to, polyethylene, polypropylene, polystyrene, polyvinyl chloride, polymethyl methacrylate, etc. Exemplary hand tool 50 made from an engineering plastic, can be manufactured by using techniques such as, but not limited to, blow molding, injection molding, thermoforming, pressure forming, computer numerical control (CNC) machining, etc. In some configurations of hand tool 50 can be made from alloys such as, but not limited to, steel. Manufacturing processes for hand tool 50, made from metals or alloys can be, but not limited to, expendable mold casting, non-expendable mold casting, sintered, or a combination thereof.

Continuing to refer primarily to FIG. 2, first configuration of hand tool 50 can further comprise one or more work stations that can be configured to retain work piece/s 20 (FIGS. 1A-1D). The first configuration of exemplary hand tool 50 can comprise a first work station 60 and a second work station 70. Each work station 60, 70 can perform similar or dissimilar operations on one or more work piece/s 20 (FIGS. 1A-1D). First work station 60 and second work station 70 can be further configured to simultaneously perform their respective operations on either a common or distinct work piece 20 (FIG. 1A-1D). The first work station 60 can further comprise a repository 63 that can be configured to receive at least one work piece 20 (FIGS. 1A-1D). The first repository 63 can be a cradle or a trench or a similar structure with at least one side wall and a base region that can be configured to retain work piece 20 (FIGS. 1A-1D). Alignment and/or retaining of the work piece/s 20 (FIGS. 1A-1D) can be achieved by providing features for example, but not limited to, at least one contouring feature 61 (FIG. 3A-3B), at least one indent feature 120, 121 (FIG. 4A, 4B), at least one protrusion or a combination thereof. In some configurations, the features can complement dimensions of at least one work piece 20 (FIG. 1A-1D) received in the first repository 63 and can be disposed on the walls and/or base of the first repository 63. The second work station 70 can comprise a second repository 73 configured to provide features similar or dissimilar to first repository 63. In some configurations, second repository 73 can comprise at least one side wall and a base, configured to receive and retain at least one work piece 20 (FIG. 1A-1D) therein. Second repository 73 can further comprise aligning and/or retaining feature same as or distinct from aligning and/or retaining features of the first repository 63, that can contribute in retaining work piece/s 20 (FIG. 1A-1D) in a known configuration. In some configurations, the aligning and/or retaining features can be integral to the structure of repositories 63, 73, while in some configurations, a distinct alignment member can be engaged or joined with the repository structure.

Figures 4A, 4B, 4C:
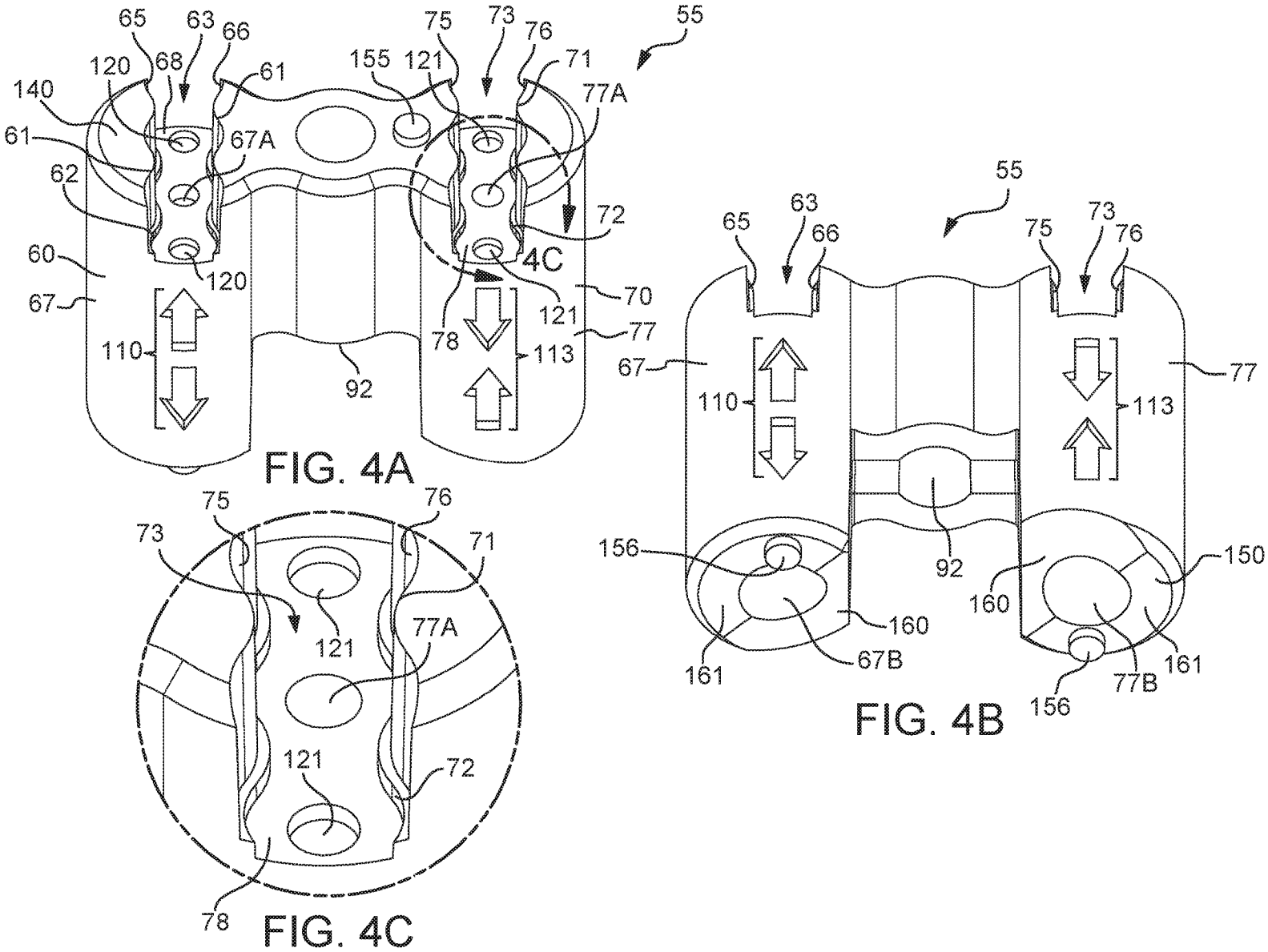
FIGS. 4A-4B depict perspective views of an exemplary prime body of the first hand tool configuration.
FIG. 4C depicts a detailed view of alignment features in at least one repository of first hand tool configuration.

Continuing to refer primarily to FIG. 2, first repository 63 and second repository 73 can be optionally disposed at entrances of a first operative channel 67 and a second operative channel 77, respectively. Each operative channel 67, 77 can further comprise a first opening (not shown) and a second opening (not shown). Operative channels 67, 77 can extend partially or completely along a length of first work station 60 and second work station 70. In some configurations, length of first operative channel 67 can be identical to the length of operative channel 77, while in some configurations, their respective lengths can be dissimilar. A first door 80 can be configured to manage access to a first opening (not shown) of first operative channel 67 and a first opening (not shown) of the second operative channel 77. A second door 85 can be configured to manage access to a second opening (not shown) of first operative channel 67 and a second opening (not shown) of the second operative channel 77. First configuration of hand tool 50 can comprise prime body 55 to be substantially disposed between first door 80 and second door 85. First door 80 and second door 85 can be in a lock-position, as shown in FIG. 2, when access to first operative channel 67 and second operative channel 77, is restricted. In some configurations, first door 80 and second door 85 can be rested completely over first door platform 140 (FIG. 4A) and second door platform 150 (FIG. 4B), respectively, when locked. First door 80 and second door 85 can be in an open-position (FIG. 7A) when access to first operative channel 67 and second operative channel 77, is partially and/or completely available. An open position of first door 80 and second door 85 can further cause first door 80 to discontinue from being in maximum contact with first door platform 140 (FIG. 4A), and can cause second door 85 to discontinue from being in maximum contact with second door platform 150 (FIG. 4B).

Figure 3A:
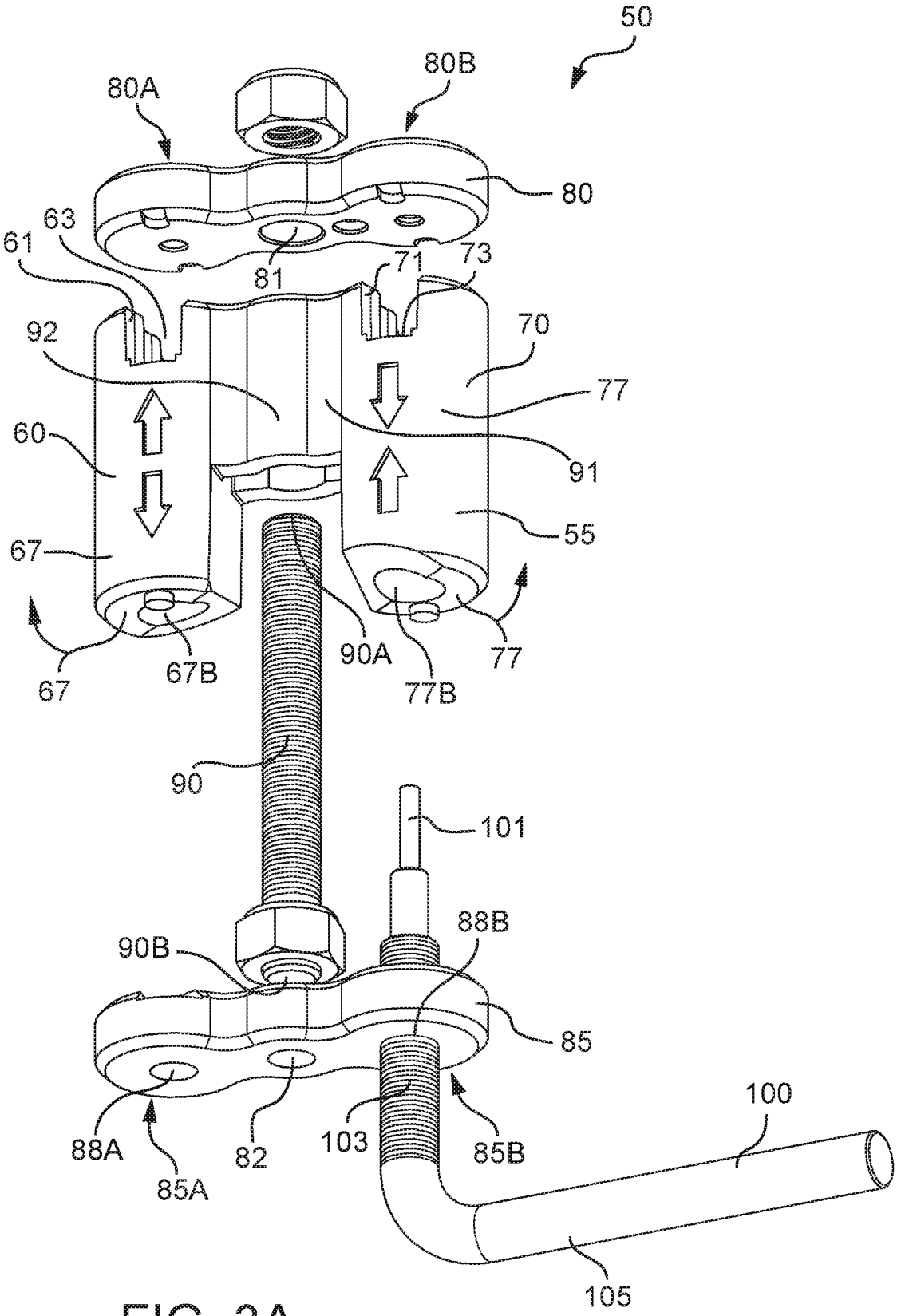
FIGS. 3A-3B depict exploded views of first hand tool configuration.
Figure 3B:
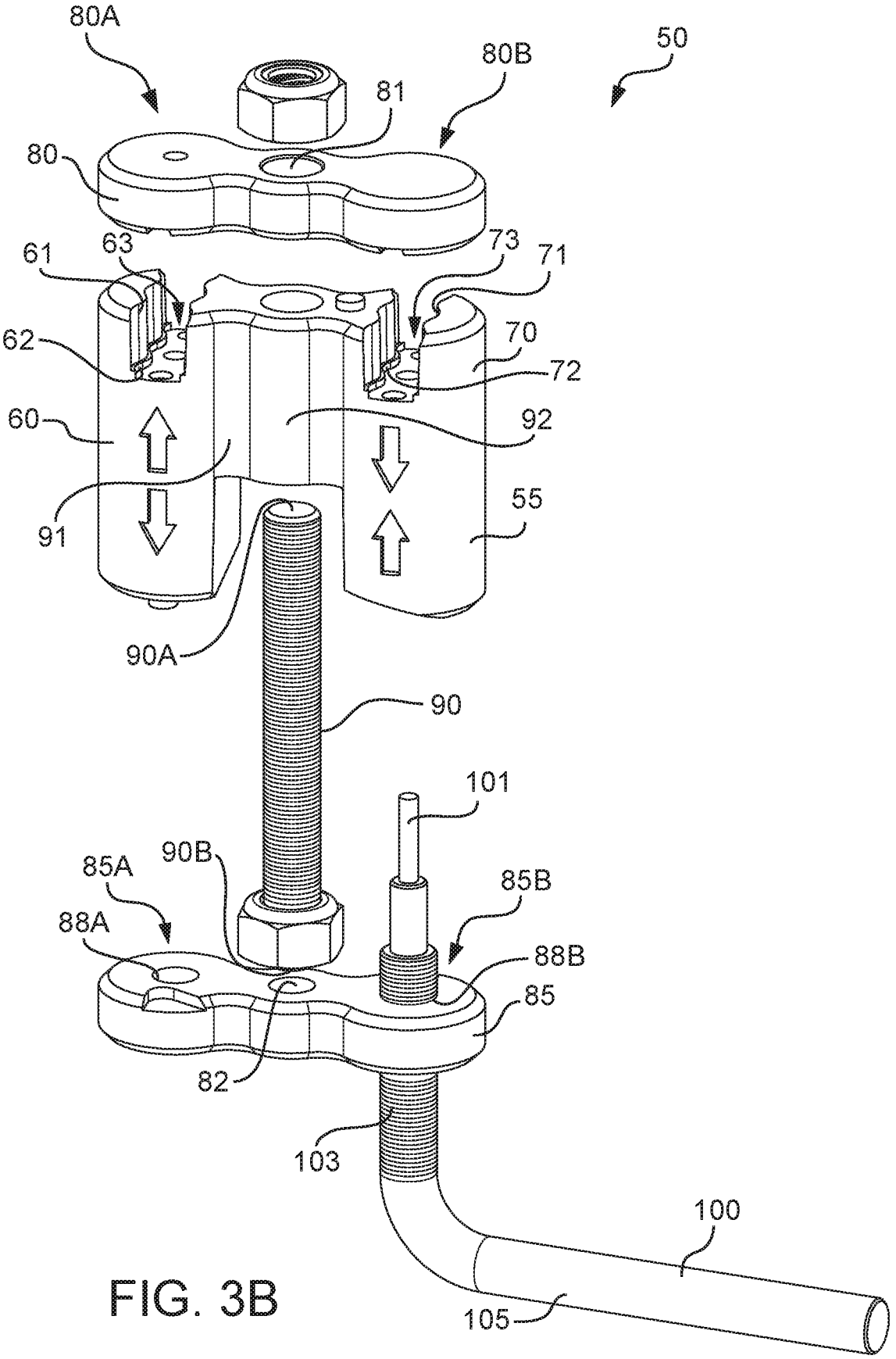

Continuing to refer primarily to FIG. 2, first door 80 and second door 85 of hand tool 50, can be further engaged by way of at least one connector 90 having first terminal 90A (FIGS. 3A-3B) and second terminal 90B (FIGS. 3A-3B). First door 80 can be engaged with first terminal end 90A (FIGS. 3A-3B) and second door 85 can be engaged with second terminal end 90B (FIGS. 3A-3B). In some configurations, connector 90 can be disposed in a connector sleeve 92 that can be provided in a bridging wall 91 (FIGS. 3A-3B) of prime body 55. In some configurations connector sleeve 92 (FIGS. 3A-3B) can be disposed outside of prime body 55. Above discussed disposition of the connector sleeve 92 (FIGS. 3A-3B) can cause it to be substantially parallel to first operative channel 67 and/or second operative channel 77. Disposition of the connector 90 in connector sleeve 92 (FIGS. 3A-3B) can be such that connector 90 can retain its ability to rotate and/or slide within connector sleeve 92 (FIGS. 3A-3B).

Continuing to refer primarily to FIG. 2, hand tool 50 can comprise at least one manipulator 100 that can include, but is not limited to including, an insert portion 103 and a handle portion 105. Manipulator 100 can be configured to access first-operative channel 67 and/or second operative channel 77 through at least one access window 88A/88B (FIGS. 6A/6B), that can be provided on second door 85. In situation where the second door 85 does not guard, the first operative channel 67 and/or the second operative channel 77, manipulator 100 can access the operative channels 67, 77, through a second opening 67B (FIG. 3A) of first operative channel 67 and second opening 77B (FIG. 3A) of the second operative channel 77. An angular relationship can be maintained between insert portion 103 and handle portion 105 of manipulator 100 to provide leverage when using hand tool 50 together with manipulator 100. Handle portion 105 can be utilized by a user to drive insert portion 103 into the operative channels 67, 77. In some configurations, an external tool such as, but not limited to a wrench tool can be employed for operating manipulator 100, in which case configuration of manipulator 100 can include a complementing configuration of the wrench tool. Additionally, manipulators 330, 430 (FIG. 10) of a second hand tool configuration 200 (FIG. 9A, 9B), discussed herein, can also be employed for accessing first operative channel 67 and/or second operative channel 77 of first exemplary configuration of hand tool 50. Moreover, an external tool that can be dimensioned to enter operative channels 67, 77 and can contact pin 40 (FIGS. 1A-1D), can be employed as an alternative to manipulator 100.

Referring now primarily to FIGS. 3A and 3B, positioning and engagement of components can form a first configuration of hand tool 50. In some configurations, first door 80, prime body 55 and second door 85 can be coupled by way of connector 90. The coupling can be enabled by partially or completely receiving connector 90 into connector sleeve 92 that can be provided in bridging wall 91. As a result, connector 90 can be disposed between first work station 60 and second work station 70, such that a first terminal end 90A of connector 90 can be adjacent to first opening 67A (FIG. 4A) of first operative channel 67 and first opening 77A (FIG. 4A) of second operative channel 77. In some configurations, above discussed coupling can further cause first terminal end 90A to be centrally disposed between first opening 67A (FIG. 4A) of first operative channel 67 and first opening 77A (FIG. 4A) of second operative channel 77. Likewise, insertion of connector 90 into connector sleeve 92 can cause second terminal end 90B to be adjacent to second opening 67B of first operative channel 67 and second opening 77B of second operative channel 77. In some configurations, above discussed coupling can further cause second terminal end 90B to be centrally disposed between second opening 67B of first operative channel 67 and second opening 77B of second operative channel 77. First door 80 can be engaged with connector 90 by way of a first connector hole 81 that can be disposed on first door 80. Such an engagement can be achieved by partially or completely receiving terminal end 90A of connector 90, into first connector hole 81. First door 80 can be disposed such that a first segment 80A of first door 80 can manage access to first opening 67A (FIG. 4A) of first operative channel 67 and second segment 80B of first door 80 can manage access to first opening 77A (FIG. 4A) of second operative channel 77. In some configurations of first door 80, first connector hole 81 can be disposed central to first segment 80A and second segment 80B thereof.

Continuing to refer to FIG. 3A and FIG. 3B, second terminal end 90B of connector 90, can partially or completely extend from connector sleeve 92. Second terminal end 90B can be positioned between second opening 67B of first operative channel 67 and second opening 77B of second operative channel 77. Extended terminal end 90B can be received into a second connector hole 82 of second door 85. Such an engagement can cause prime body 55 and first door 80 to be engaged with second door 85. Second door 85 can further comprise first access window 88A and a second access window 88B. Disposition of two access windows 88A, 88B can be such that first access window 88A can align with second opening 67B of first operative channel 67 and second access window 88B can align with second opening 77B of second operative channel 77. As a result of the alignment, insert portion 103 of manipulator 100 can access first operative channel 67 and/or second operative channel 77 through corresponding first access window 88A (FIG. 3A/3B) and second access window 88B (FIG. 3A/3B). Insert portion 103 can further comprise an insert end with at least one pin segment 101. Pin segment 101 can be dimensioned to enter first operative channel 67 and or second operative channel 77 by way of first access window 88A and/or second access window 88B, respectively. In some configurations, insert portion 103 can comprise a plurality of male threads that can match a plurality of corresponding female threads (not shown) that can be provided in first access window 88A (FIG. 3A/3B) and/or second access window 88B (FIG. 3A/3B).

Referring now primarily to FIGS. 4A-4C, an exemplary configuration of prime body 55 is depicted. An exemplary operation of first work station 60 can be to perform a disassembling operation on at least one work piece, such as work piece 20 (FIGS. 1A-1D). An exemplary operation of second work station 70 can be to perform an assembling operation on two or more work pieces, such as work piece/s 20 (FIGS. 1A-1D) to form at least one assembled work piece 20 (FIGS. 1A-1D). Operational indicators can be provided on each of the work stations. These operational indicators can direct a user of hand tool 50, to an appropriate work station for performing a required operation. For example, a first pair of operational indicators 110 can be provided on first work station 60. In some configurations, first pair of operational indicators 110 can be configured to indicate that a disassembling operation can be performed at first work station 60. Likewise, a second pair of operational indicators 113 can be provided on second work station 70 that can indicate a user about performing an assembling operation at second work station 70.

Figure 1C:
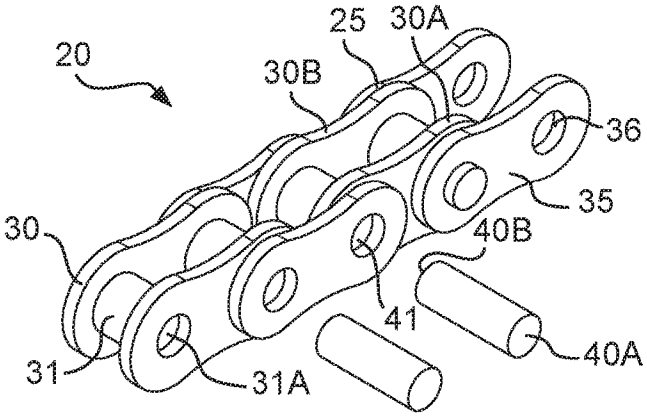
Figure 1D:
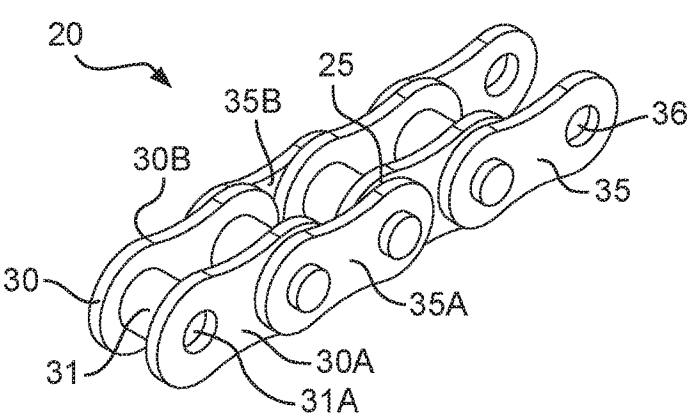
Figure 7H:
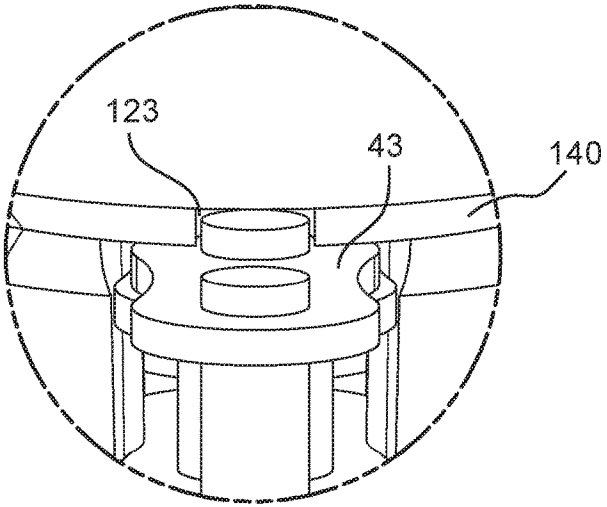
FIG. 7H depicts a detailed view of a neighboring pin received in a pocket of the first door when the first door is in a closed position.
Figure 7G:
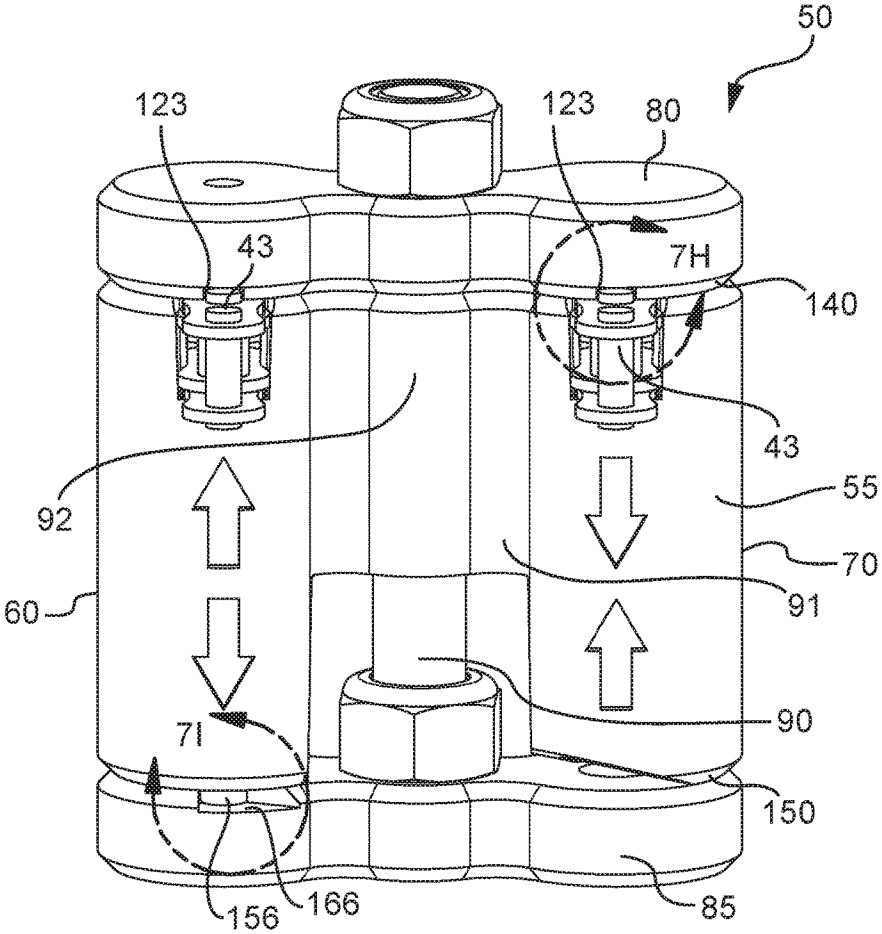
FIG. 7G depicts a front perspective view of the first hand tool configuration with a work piece to be disassembled in a first repository and first and second work pieces in the second repository, the first door and the second door are in a closed position.
Figure 8A:
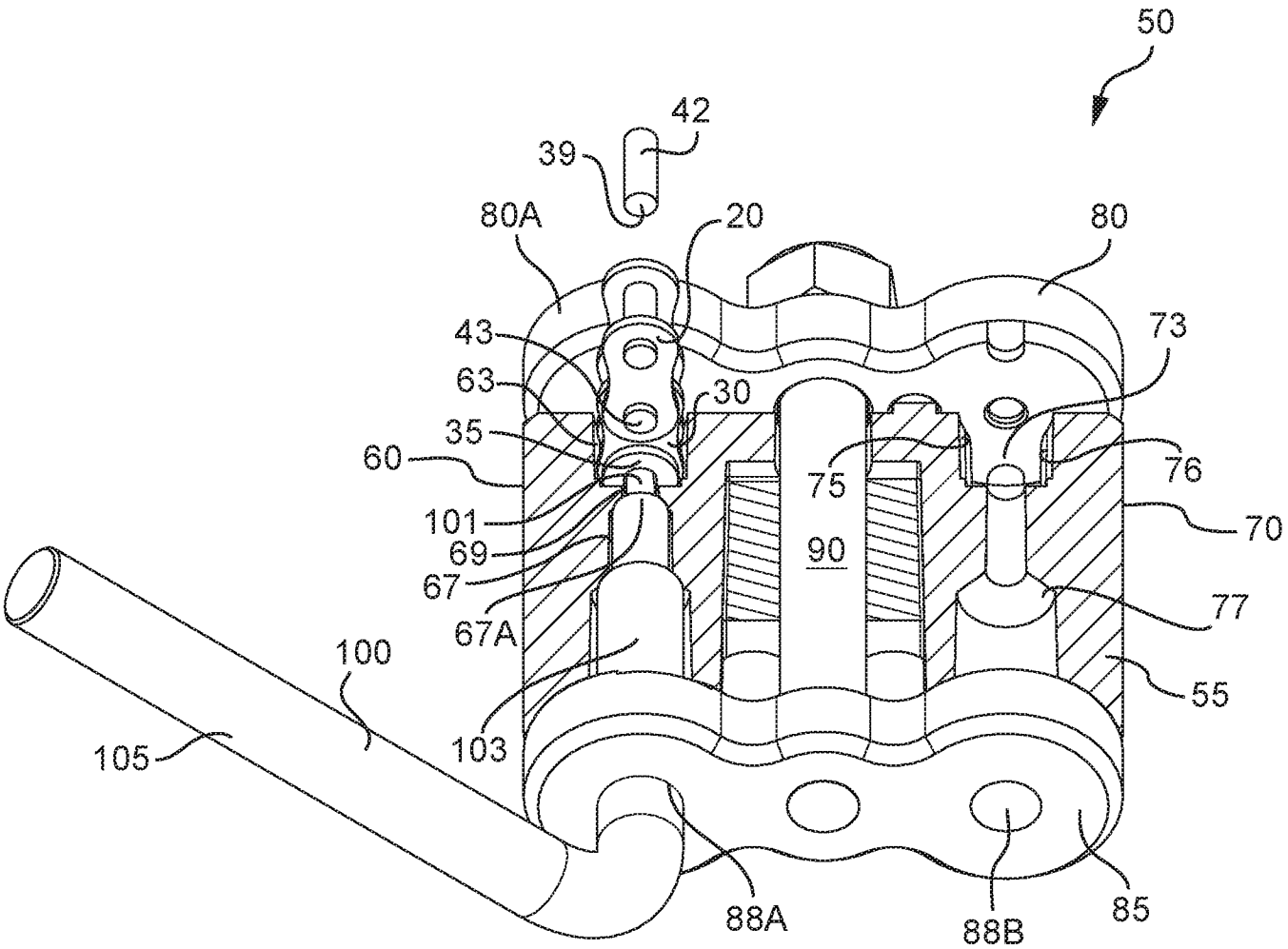
FIGS. 8A-8B depict cross section views of prime body in the first hand tool configuration.

Continuing to refer primarily to FIGS. 4A-4C, first work station 60 can further comprise first repository 63 that can be configured to receive and retain at least one work piece 20 (FIGS. 1A-1D), on which a disassembling operation can be performed. First repository 63 can further comprise a first wall 65, a second wall 66 and a base 68. A plurality of aligning and/or retaining features such as, but not limited to, first set of contours 61, second set of contours 62, pin indents 120, (FIG. 4A) can be provided in first repository 63, to ensure an appropriate placement of at least one work piece 20, therein. Walls 65, 66 of first repository 63 can comprise first set of contours 61 and second set of contours 62. In some configurations, first set of contours 61 can occupy a larger area of walls 65, 66, compared to area occupied by second set of contours 62. In some configurations, first set of contours 61 can be configured to suit at least one of interior linkable unit 30 (FIG. 1A-1D) of work piece 20 (FIG. 1A-1D), whereas second set of contours 62 can be configured to suit at least one exterior linkable unit 35 (FIG. 1A-1D), thereof. Such an arrangement can cause walls 65 and 66 to be uneven along their respective lengths. In some configurations, the unevenness can be towards base 68 of first repository 63. First base 68 of first repository 63 can comprise a first set of indents 120 that can be configured to receive and securely retain one or more components of work piece/s 20 when an operation is being performed thereupon. In some configurations, the one or more retained components can be, but not limited to, ends 40A, 40B (FIGS. 1A-1D) of neighboring pins 43 (FIGS. 7G, 7H), that can be disposed adjacent to target pin 42 (FIG. 8A) and/or adjacent to a potential link 41 (FIG. 1C and FIG. 8A). Resting of ends 40A (FIGS. 1A-1D) and/or 40B (FIGS. 1A-1D) of neighboring pins 43 (FIGS. 7G, 7H) into respective set of indents 120 can assist in retaining work piece 20 in first repository 63. The aligning and/or retaining features can collectively ensure a desired configuration of work piece/s 20 in first repository 63. In some configurations, base 68 can be configured to receive work piece/s 20 in more than one configuration.

Continuing to refer to FIGS. 4A-4C, second repository 73 can further comprise first wall 75 and second wall 76 along with base 78 (FIG. 4C). Walls 75, 76 can be configured to further comprise a first set of contours 71 (FIGS. 4A/4C) and a second set of contours 72 (FIG. 4C), that can compliment structure and dimensions of work pieces/s 20A, 20B (FIG. 7D), received therein. In some configurations, first set of contours 71 (FIGS. 4A/4C) can occupy a larger area of walls 75, 76, compared to area occupied by second set of contours 72 (FIGS. 4A/4C). In some configurations, first set of contours 71 (FIGS. 4A/4C) can be configured to suit at least one of the interior linkable unit 30 (FIGS. 1A-1D) of work piece 20 (FIGS. 1A-1D), whereas second set of contours 72 (FIG. 4C) can be configured to suit at least one exterior linkable unit 35 (FIGS. 1A-1D), thereof. Such an arrangement can cause walls 75 and 76 to be uneven along their respective lengths. In some configurations, the unevenness can be towards base 78 (FIG. 4C) of second repository 73. Second pair of indents 121 (FIG. 4C) can also be provided on base 78 (FIGS. 4A/4C) of second repository 73. Second pair of indents 121 (FIG. 4C) can be configured to receive and securely retain at least one component of work piece/s 20 (FIGS. 1A-1D). In some configurations, alignment features of first repository 63 can be similar to alignment features of second repository 73.

Figure 5A:
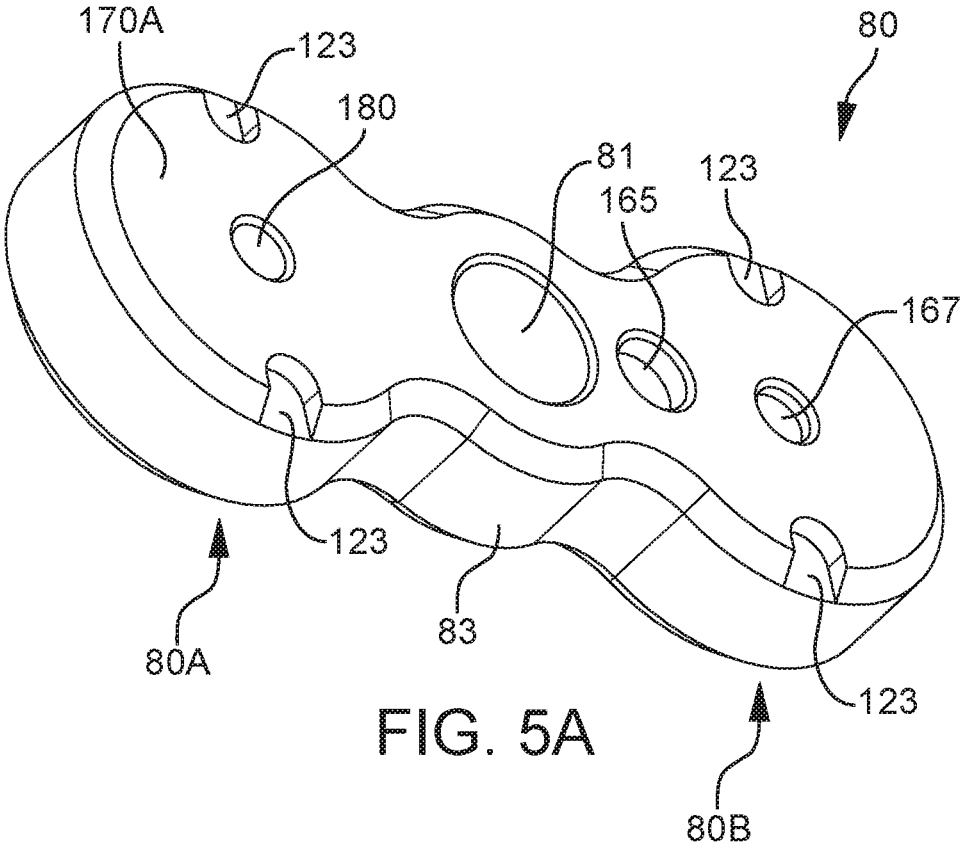
FIGS. 5A-5B depict perspective views of an exemplary first door of the first hand tool configuration.
Figure 6A:
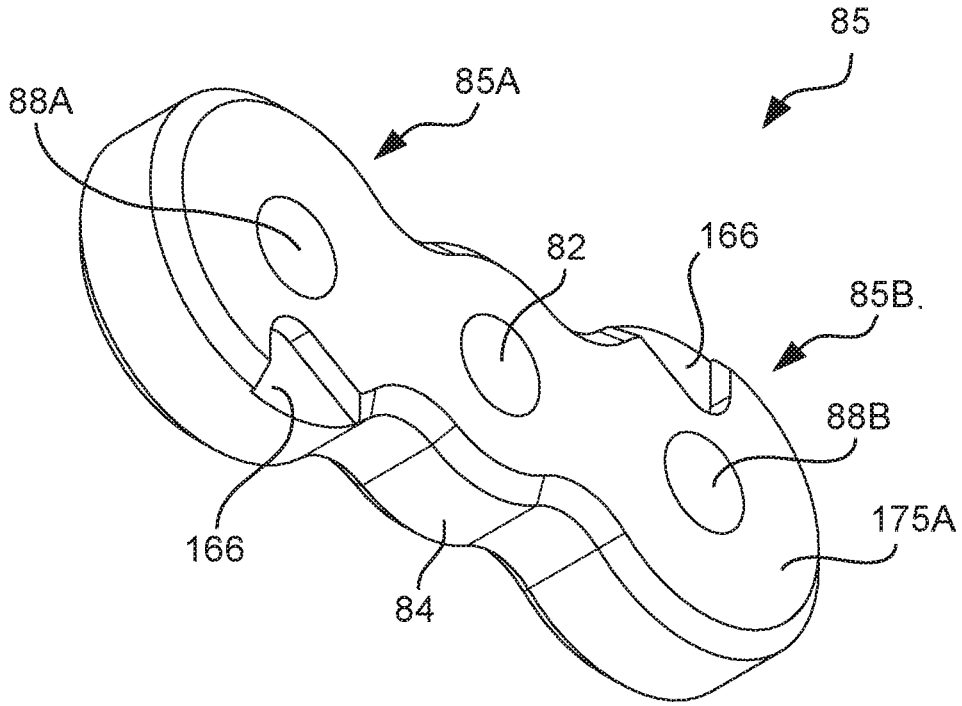
FIGS. 6A-6B depict perspective views of an exemplary second door of the first hand tool configuration.

Continuing to refer primarily to FIG. 4A and FIG. 4B, first configuration of hand tool 50 can further comprise a first door platform 140 (FIG. 4A) and a second door platform 150 (FIG. 4B). In some configurations, first door platform 140 (FIG. 4A) can be positioned to comprise entrances to first repository 63 and second repository 73, while second door platform 150 (FIG. 4B) can be configured to include second opening 67B (FIG. 4B) of first-operative channel 67 and second opening 77B (FIG. 4B) of second operative channel 77. First door platform 140 (FIG. 4A) can substantially oppose second door platform 150 (FIG. 4B). First door platform 140 (FIG. 4A) can be further configured to allow first door 80 (FIGS. 3A/3B) to partially or completely rest thereupon. Likewise, a second door platform 150 (FIG. 4B) can allow second door 85 (FIGS. 3A/3B) to partially or completely rest thereupon. In some configurations, first door platform 140 (FIG. 4A) can further comprise at least one raised feature 155 (FIG. 4A), that can optionally serve as an alignment feature for when first door 80 (FIGS. 3A/3B), completely or partially rests on first platform 140 (FIG. 4A). Raised feature 155 (FIG. 4A) can be accepted in compartment 165 (FIG. 5A) on first door 80 (FIG. 5A), to achieve alignment. Interaction between raised feature 155 (FIG. 4A) and compartment 165 (FIG. 5A) can cause first door 80 (FIGS. 3A/3B) to continue staying in a partial resting or complete resting position on first platform 140 (FIG. 4A). Similar or distinct features can also be provided on second door platform 150 (FIG. 4B), to achieve an alignment when second door 85 (FIGS. 3A/3B) partially or completely rests on second platform 150 (FIG. 4B). Second door platform 150 (FIG. 4B) can comprise at least one projection 156 (FIG. 4B) that can be received into pockets 166 (FIG. 6A) of second door 85. Projection/s 156 (FIG. 4B) can serve as blocking features to prevent second door 85 (FIG. 6A/6B) from rotating beyond a desired extent when second door 85 (FIGS. 6A/6B) rests completely on second platform 150 (FIG. 4B). Projection/s 156 (FIG. 4B) can provide positive feedback that the user hasn't under-rotated the part into position. In some configurations, projection/s 156 (FIG. 4B) can operably couple with corresponding pocket/s 166 (FIG. 6A). Ramp feature 160 (FIG. 4B) can place connector 90 (FIG. 2) in a state of tension, which can hold both door 80 (FIGS. 5A/5B) and door 85 (FIGS. 6A/6B) in place after door 85 (FIGS. 6A/6B) is rotated into position. In some configurations, second door 85 (FIGS. 6A/6B) can be configured to be in a locked position when it can prevent access to second opening 67B (FIG. 4B) of first operative channel 67 (FIGS. 4A/4B) and second opening 77B (FIG. 4B) of second operative channel 77 (FIGS. 4A/B). Similar or distinct blocking features can also be provided on first door platform 140 (FIG. 4A) for first door 80 (FIGS. 5A/5B). Second door platform 150 (FIG. 4B) can further comprise a substantially planar portion 161 (FIG. 4B) and a reclining portion 160 (FIG. 4B). Complete resting of second door 85 (FIGS. 6A/6B) on second platform 150 (FIG. 4B), can cause surface area of planar portion 161 (FIG. 4B) of second platform 150 (FIG. 4B) to be in communication with second door 85 (FIGS. 6A/6B). Reclining portion 160 (FIG. 4B) of second platform 150 (FIG. 4B) can be disposed to encourage second door 85 (FIGS. 6A/6B) to displace from a completely rested position to a position in which second door 85 (FIGS. 6A/6B) does not interface second door platform 150 (FIG. 4B) and vice versa.

Figure 5B:
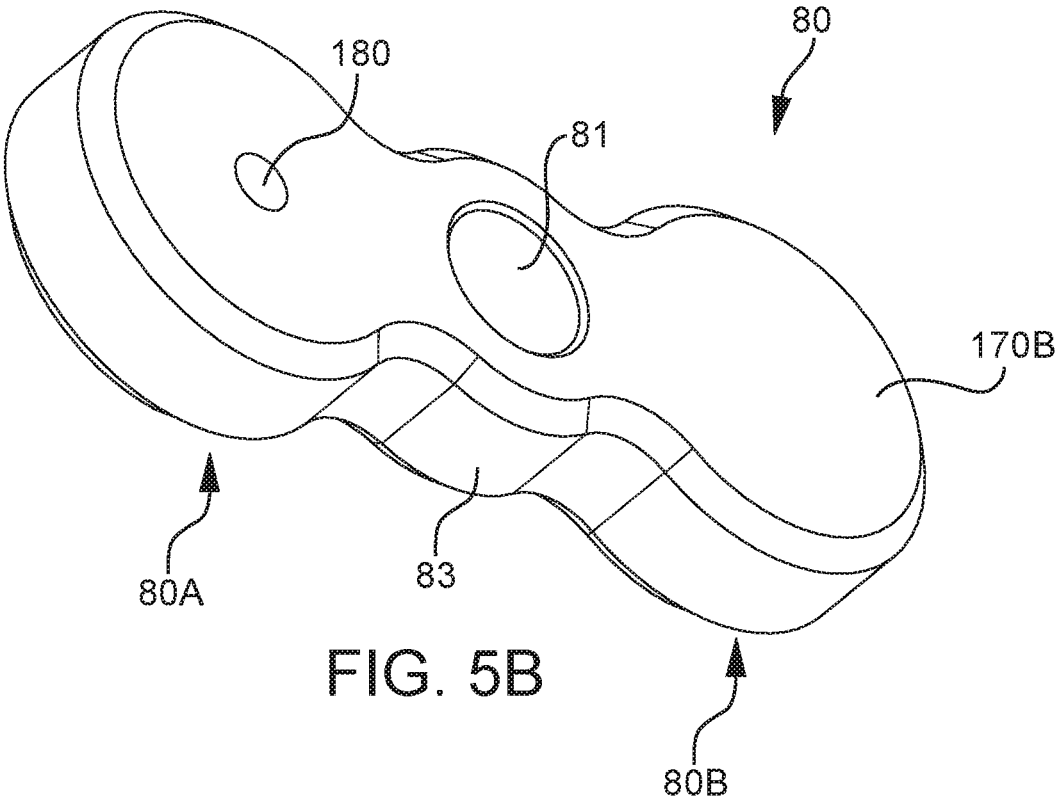

Referring now primarily to FIG. 5A and FIG. 5B, first door 80 can further comprise inner surface 170A (FIG. 5A) that can be configured to face first door platform 140 (FIG. 4A), and an outer surface 170B (FIG. 5B) that can be configured to face away from first door platform 140 (FIG. 4A). First door 80 can be configured to manage access to first operative channel 67 (FIGS. 3A/3B) and second operative channel 77 (FIGS. 3A/3B). Specifically, first segment 80A of first door 80 can serve as an access manager of first operative channel 67 (FIGS. 3A/3B) and second segment 80B can serve as an access manger of second operative channel 77 (FIGS. 3A/3B). In some configurations, first segment 80A and second segment 80B of first door 80 can interchangeably serve as access mangers for first operative channel 67 (FIGS. 3A/3B) and/or second operative channel 77 (FIGS. 3A/3B). Each segment of first door 80 can be dedicated to a work station 60/70 (FIG. 2), and can contribute in performing a pre-determined operation of the work station 60/70 (FIG. 2). First segment 80A and second segment 80B of first door 80 can further comprise a common junction 83. Common junction 83 can further include a first connector hole 81 that can be configured to receive connector 90 (FIGS. 3A/3B). This engagement can cause first door 80 to be rotatably connected to connector 90 (FIGS. 3A/3B). In some configurations, first segment 80A can be committed towards first work station 60 (FIG. 2) and can participate in at least one disassembling operation performed therein. Second segment 80B can be committed towards second work station 70 (FIG. 2) and can participate in at least one assembling operation performed therein.

Continuing to refer primarily to FIG. 5A and FIG. 5B, besides managing access to first opening 67A (FIG. 3A/3B) of first operative channel 67 (FIG. 3A) and first opening 77A (FIGS. 3A/3B) of second operative channel 77 (FIG. 3A), structure of prime body 55 (FIGS. 3A/3B) can cause first door 80 to also guard first repository 63 (FIG. 4A/4B) and second repository 73 (FIGS. 4A/4B). Work piece 20 (FIGS. 1A-1D) can be retained in first repository 63 (FIGS. 4A/4B) such that a disassembling operation can be performed on target pin 42 (FIG. 8A) of work piece 20 (FIGS. 1A-1D). Retention of work piece 20 (FIGS. 1A-1D) can be achieved by causing first door 80 (FIG. 3A/3B) to be completely rested or, in some configurations, partially rested on first door platform 140 (FIG. 4A). Complete resting position of first door 80 on first door platform 140 (FIG. 4A) can cause at least one target pin 42 (FIG. 8A) to be accommodated at an entrance of outlet 180 of first segment 80A. During a disassembling operation, target pin 42 (FIG. 8A) can be driven into outlet 180 and can be subsequently removed from first work station 60 (FIGS. 3A/3B) therethrough. Retaining of work piece 20 (FIGS. 1A-1D) can further allow a first end of neighboring pins 43 (FIG. 8A) to be accommodated in pin pockets 123 on first door 80 and a second end of neighboring pins 43 (FIG. 8A) can be accommodated into indents 120 (FIG. 4A) of repositories 63 (FIG. 4A), respectively. During an assembling operation, assembling pin 40C (FIG. 8B) can be blocked from travel beyond barrier 167 (FIG. 5A), whereas first ends of neighboring pins 43 (FIG. 8A) can be accommodated in pin pockets 123 of second segment 80B, and corresponding second ends of neighboring pins 43 (FIG. 8A) can be accommodated into indents 121 (FIG. 4C) of repositories 73 (FIGS. 4A-C).

Figure 6B:
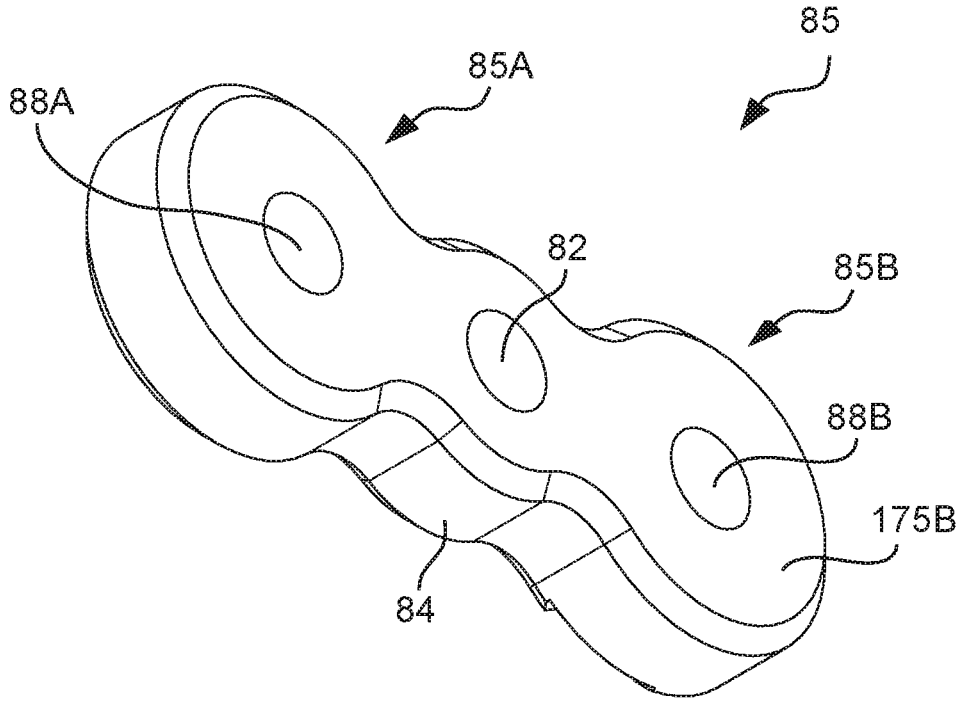

Referring now primarily to FIG. 6A and FIG. 6B, second door 85 can further comprise an inner surface 175A (FIG. 6A) configured to face second door platform 150 (FIG. 4B) and an outer surface 175B (FIG. 6B) configured to face away from second door platform 150 (FIG. 4B). Second door 85 can be divided into a first segment 85A (FIG. 6A) and a second segment 85B (FIG. 6B). In some configurations, first segment 85A (FIG. 6A) of second door 85 can be dedicated to first work station 60 (FIGS. 3A/3B) while second segment 85B (FIG. 6B) of second door 85 can be dedicated to second work station 70 (FIGS. 3A/3B). In some configurations, first segment 85A (FIG. 6A) and second segment 85B (FIG. 6B) can be interchangeably used for first work station 60 (FIGS. 3A/3B) and/or second work station 70 (FIGS. 3A/3B). Common junction 84 can be provided between first segment 85A (FIG. 6A) and second segment 85B (FIG. 6B). Common junction 84 can further comprise second connector hole 82. Second terminal end 90B (FIG. 3A/3B) of connector 90 (FIG. 3A/3B) can be received in second connector hole 82, thereby rotatably engaging second door 85 with connector 90 (FIG. 3A). Second door 85 can further comprise first access window 88A on first segment 85A (FIG. 6A) and second access window 88B on the second segment 85B (FIG. 6B) of second door 85. In some configurations, prime body 55 (FIGS. 3A/3B) can be configured such that first access window 88A can provide access to second opening 67B (FIG. 4B) of first operative channel 67 (FIGS. 3A/3B), and second access window 88B can provide access to second opening 77B (FIG. 4B) of second operative channel 77 (FIGS. 3A/3B). In some configurations, interchangeable use of first segment 85A (FIG. 6A) and second segment 85B (FIG. 6B) of second door 85 can also offer an interchangeable use of first access window 88A and second access window 88B. Additionally, first and second access windows 88A, 88B can be dimensioned to receive insert portion 103 (FIGS. 3A/3B) of manipulator 100 (FIGS. 3A/3B) therein and subsequently into first operative channel 67 (FIGS. 3A/3B) and/or second operative channel 77 (FIGS. 3A/3B).

Continuing to refer primarily to FIG. 6A and FIG. 6B, second door 85 can be partially or completely rested on second door platform 150 (FIG. 4B). A lock position of second door 85 can cause second door 85 to be completely rested on second door platform 150 (FIG. 4B) whereas an open position can cause second door 85 to be partially rested on second door platform 150 (FIG. 4B). In some configurations, second door 85 can be in an open position when it does not interact with second door platform 150 (FIG. 4B). When completely rested on second platform 150 (FIG. 4B), second door 85 can apply a force, such as but not limited to a compressing force, on body 55 (FIGS. 3A/3B) of hand tool 50 (FIGS. 3A/3B). This force can be released when second door 85 slides from planar portion 161 (FIG. 4B) to reclined portion 160 (FIG. 4B) of second door platform 150 (FIG. 4B). Pockets 166 (FIG. 6A) on first surface 175A (FIG. 6A) can accommodate projections 156 (FIG. 4B) that can be provided on second door platform 150 (FIG. 4B). Second door 85 can be in an open position when projections 156 (FIG. 4B) are withdrawn from pockets 166.

Figure 7A:
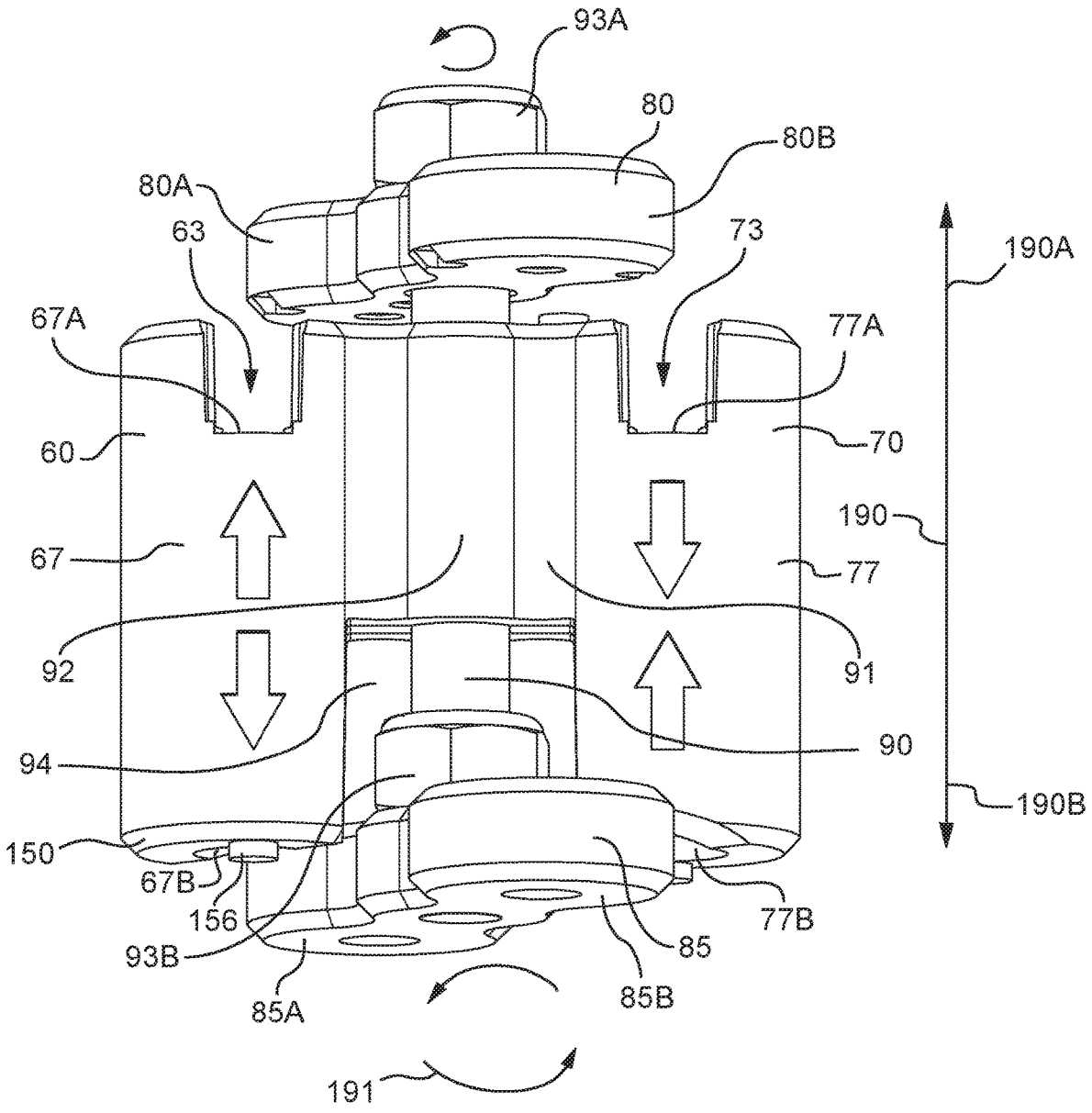
FIG. 7A depicts a perspective view of the first hand tool configuration with the first door and the second door in an open position.
Figure 7C:
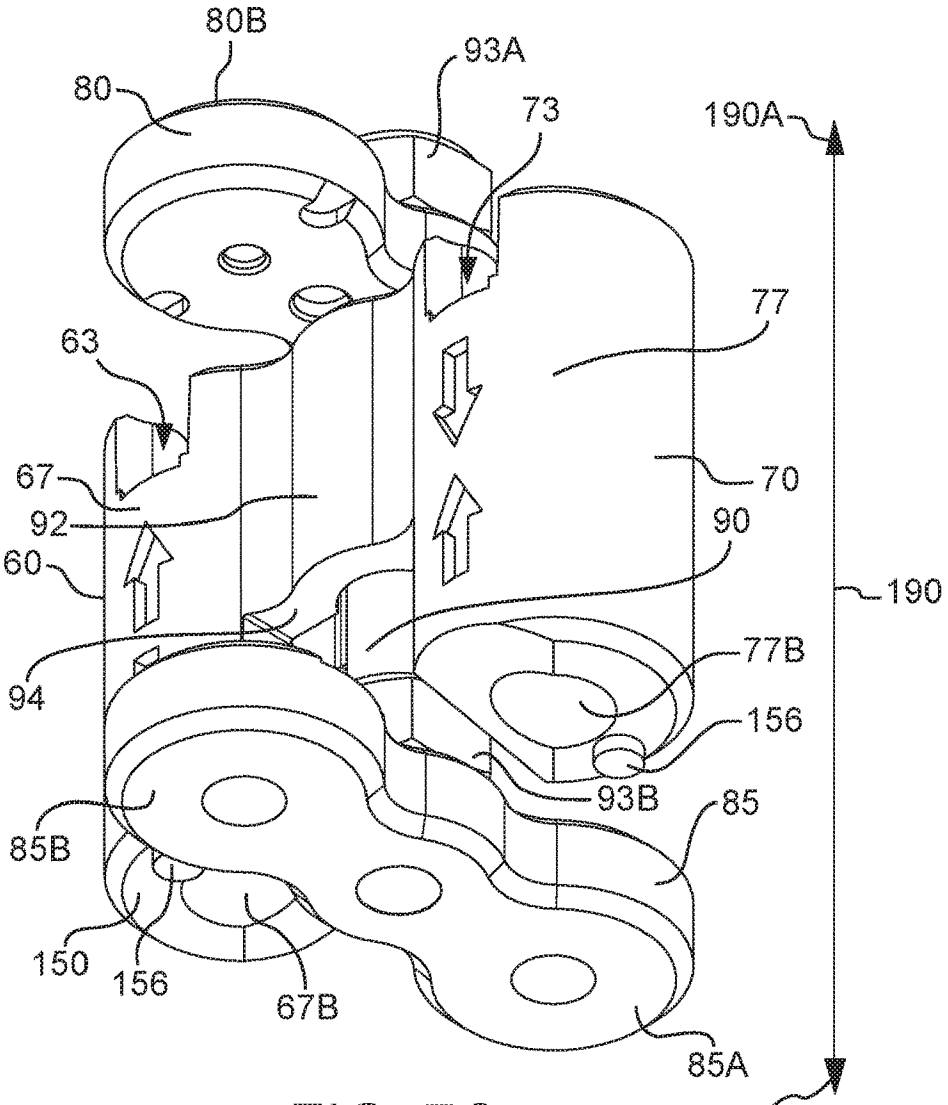
FIG. 7C depicts a front-bottom perspective view of the first hand tool configuration with the first door and the second door in an open position.
Figure 7B:
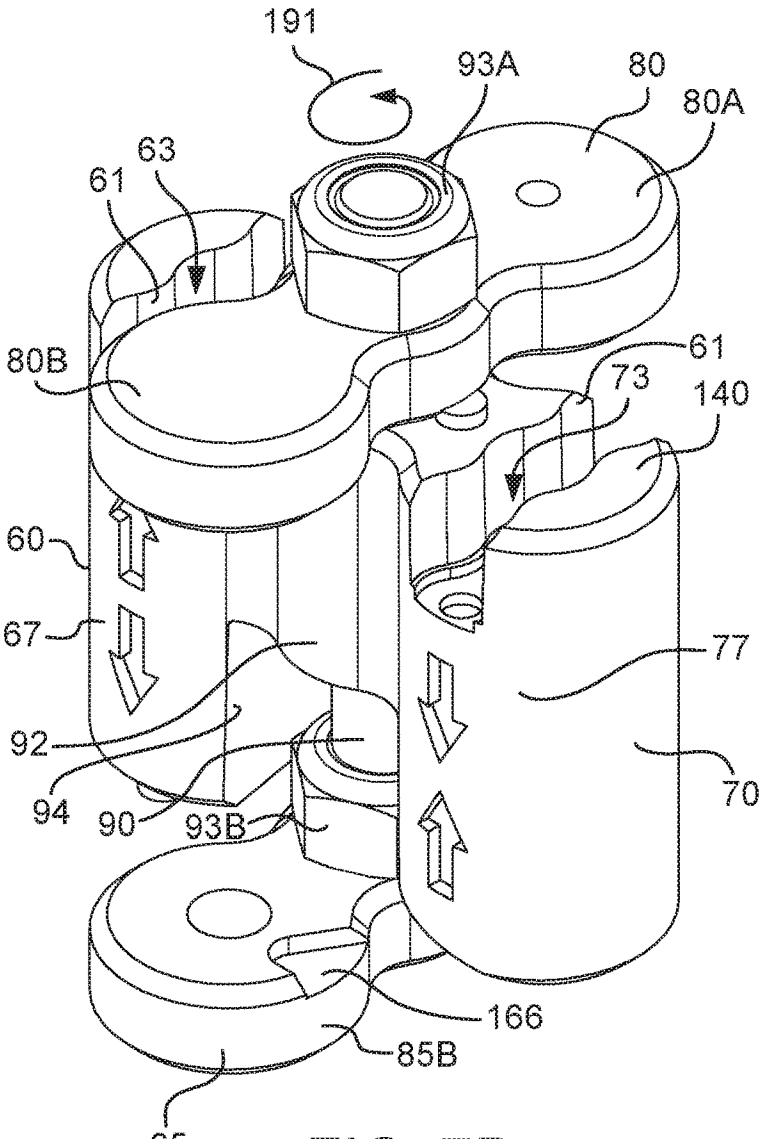
FIG. 7B depicts a front-top perspective view of the first hand tool configuration with the first door and the second door in an open position.

Referring now primarily to FIGS. 7A-7C first door 80 and second door 85 can rotate in relation to one another about second connector hole 82 (FIG. 6A) in door 85 and first connector hole 81 (FIG. 5A) in door 80 by way of connector 90. In some configurations, second door 85 can be engaged with connector 90 by receiving connector 90 in second connector hole 82 (FIGS. 6A/6B) and securing this engagement by using second connector nut 93B. Engagement between connector 90 and second door 85 can be such that rotational movement of second door 85 can cause rotational movement of connector 90 and vice versa. First door 80 can be engaged with connector 90 such that rotational movement of connector 90 and first door 85 can be independent of each other. The engagement between connector 90 and first door 85 can be achieved by first connector nut 93A. In some configurations, first connector nut 93A can be positioned at first connector terminal 90A (FIGS. 3A/3B) to prevent disengagement of connector 90 and first door 80. Second connector nut 93B can be provided at second terminal end 90B (FIGS. 3A/3B) of connector 90 to secure engagement between connector 90 and second door 85. In some configurations of hand tool 50 (FIG. 2), a part of connector 90 can be housed in connector sleeve 92 while a remainder of the connector 90 second part may not be enclosed by connector sleeve 92. In some configurations, the remainder of connector 90 can continue into a connector space 94. Connector 90 can be further configured to retain its freedom of movement in linear direction 190, and further retain its rotational freedom of movement, in rotational direction 191, while housed in connector sleeve 92 and connector space 94.

Continuing to refer to FIGS. 7A-7C, an external torque applied to the second door 85 can cause rotational motion of second door 85 and connector 90 in rotational direction 191. Engagement between second door 85 and connector 90 can influence each of their respective movements. For example, but not limited to, displacement of second door 85 from a lock position to an open position and vice versa can be influenced by above discussed engagement. Similarly, linear and/or rotational motions of connector 90 can also be influenced by said engagement. In a lock position, the second door 85 can rest on second platform 150 such that second door 85 can be parallel to a width of hand tool 50. Locked position of second door 85 can further comprise projections 156 (FIGS. 7A/7C) on second platform 150 to be engaged with pockets 166 on the second door 85. This engagement can further forbid rotational motion of second door 85, thereby restricting rotational and/or linear motion of connector 90. In some configurations, locked position of second door 85 can also influence rotational freedom of first door 80.

Continuing to refer to FIGS. 7A-7C, displacement of second door 85 from lock-position can cause the second door 85 to shift from being completely rested on second door platform 150 (FIG. 7C) such that the first segment 85A of second door 85 and second segment 85B of second door 85 gradually decrease their interaction with surface area of second door platform 150 (FIG. 7C). At a given point, interaction between surface area of second door platform 150 (FIG. 7C) and second door 85 can cause first segment 85A and the second segment 85B to discontinue restricting access to second opening 67B and second opening 77B, respectively. At this stage, linear motion of connector 90, in linear direction 190, can still be restricted if first segment 85A of second door 85 and second segment 85B of second door 85 partially interacts with second door platform 150 (FIG. 7C). In some configurations, interaction of second door 85 with planar portion 161 (FIG. 4B) of second door platform 150 (FIG. 7C), can restrict linear motion of connector 90. Lack of interaction between second door 85 and planar portion 161 (FIG. 4B) of second door platform 150 (FIG. 7C) can lift the linear movement restriction on connector 90, allowing it to move in linear direction 190.

Continuing to refer to FIGS. 7A-7C, linear motion of connector 90 in direction 190 can cause second door 85 to be pulled into or pushed out of connector space 94. For example, linear motion of connector 90 in direction 190A can cause second door 85 to be pulled into connector space 94 and a linear motion of connector 90 in direction 190B can cause the second door 85 to be pushed out of connector space 94. Displacement of connector 90, as discussed above, can further influence the relationship between first door 80 and first door platform 140 (FIG. 7B). In some configurations, movement of connector 90 in direction 190A can provide a higher degree of rotational freedom to first door 80. A locked position of first door 80 can be achieved by firstly, ensuring projections 156 (FIGS. 7A/7C) of second door platform 150 (FIGS. 7A/7C) are accommodated into pockets 166 (FIG. 7C) of second door 85 and subsequently allowing first door 80 to occupy a maximum area of first door platform 140 (FIG. 7B). Such an arrangement can cause first segment 80A of first door 80 to restrict access to first repository 63 and/or first operative channel 67 and the second segment 80B to restrict access to second repository 73 and/or second operative channel 77 of hand tool 50. An open position of first door 80 can be achieved when interaction between surface area of first door platform 140 (FIGS. 7A/7C) and first door 80 gradually reduces. Complete disconnect between first door platform 140 (FIGS. 7A/7C) and first door 80 can cause first door to be perpendicular to prime body 55, providing access to repositories 63, 73, wherein at least one work piece 20 (FIG. 7D) can reside. FIGS. 7B and 7C depict first door 80 and second door 85 to be substantially perpendicular to prime body 55.

Figure 7D:
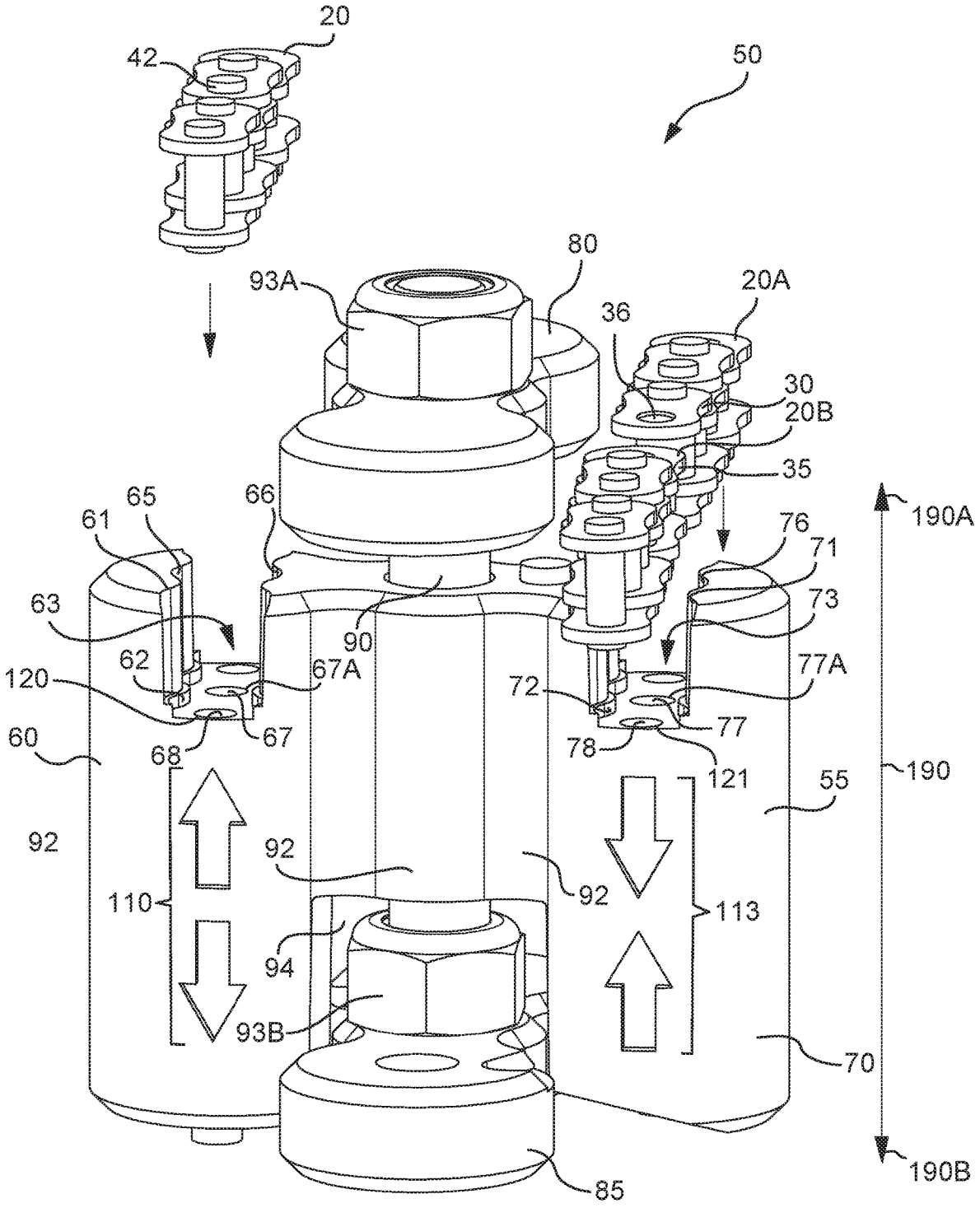
FIG. 7D depicts a front-top perspective view of the first hand tool configuration with a work piece to be disassembled configured to be received in a first repository and first and second work pieces configured to be received in the second repository.
Figure 7E:
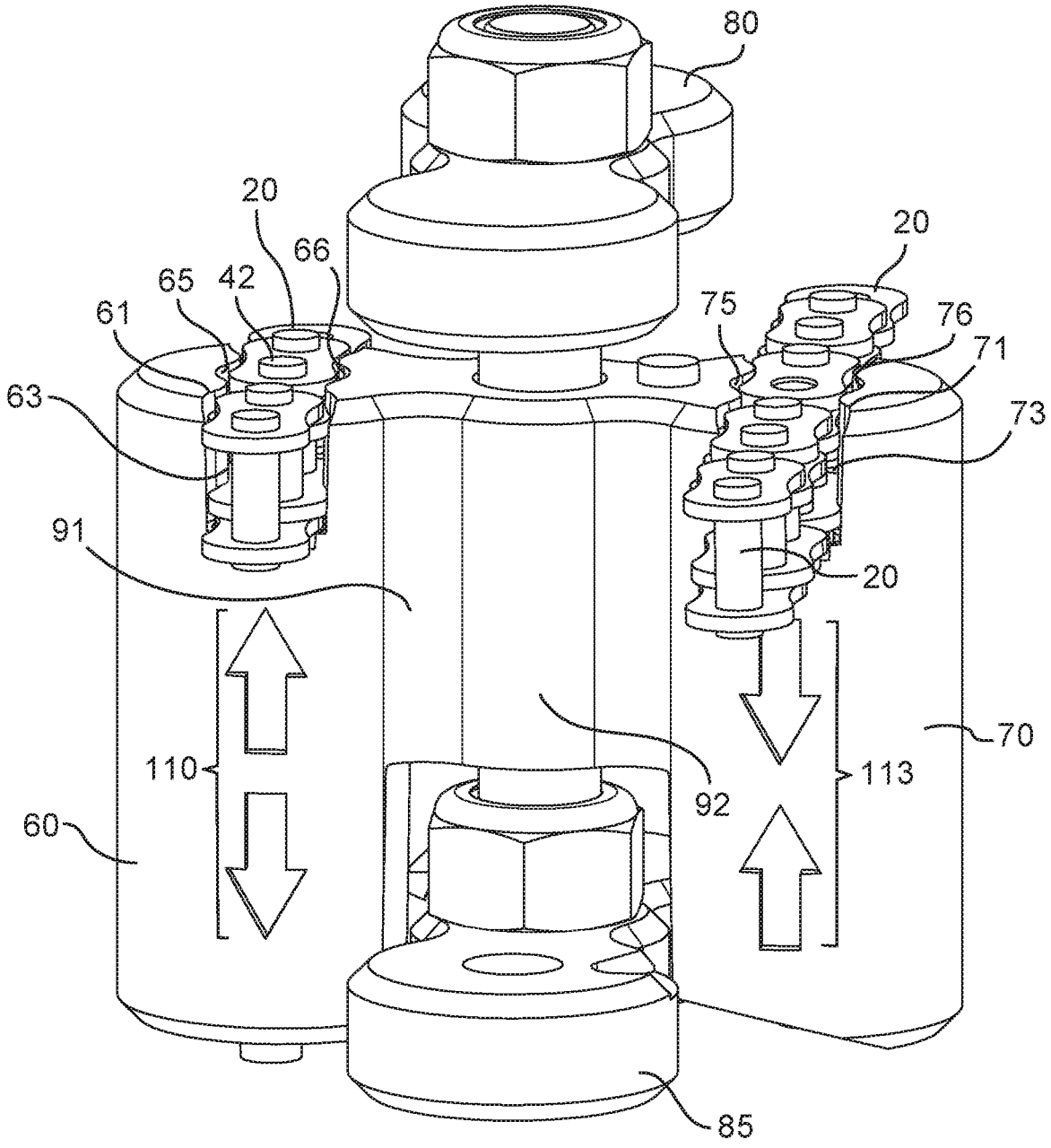
FIG. 7E depicts a front-top perspective view of the first hand tool configuration with a work piece to be disassembled in a first repository and first and second work pieces in the second repository.
Figure 7F:
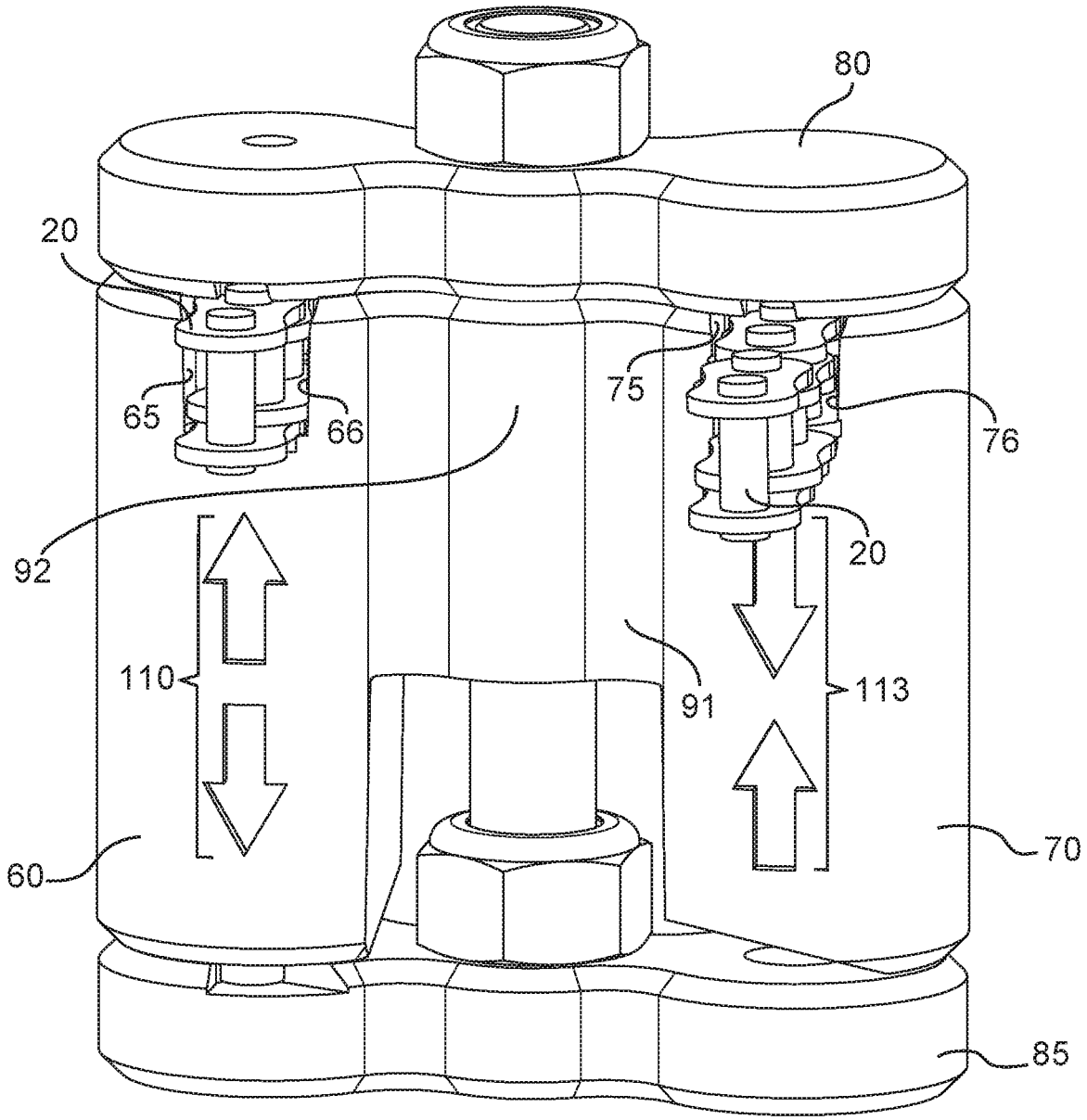
FIG. 7F depicts a front-top perspective view of the first hand tool configuration with a work piece to be disassembled in a first repository and first and second work pieces in the second repository, the first door and the second door are in a closed position.

Referring now to FIGS. 7D-7F, first work station 60 of exemplary hand tool 50 can perform a disassembling operation that can be indicated by operational indicators 110. Exemplary work piece 20 can be received into first repository 63 such that target pin 42 (FIGS. 7D/7E) can be accommodated at first opening 67A (FIG. 7D) of first operative channel 67. First repository 63 can comprise alignment features configured to ensure appropriate positioning of work piece 20 into the first repository 63. A first example of such alignment features can be but not limited to, first contouring 61 (FIGS. 7D/7E), a second contouring 62 (FIG. 7D), that can be provided on walls 65 and 66 of first repository 63, contouring 61, 62 can complement work piece 20 and/or components of work piece 20, received therein. Another example of such alignment features can be to provide at least one indents 120, 121 (FIG. 7D) on first base 68 of first repository 63 and second base 78 of second repository 73, respectively. Indents 120, 121 (FIG. 7D) can be configured to receive neighboring pins 43 (FIGS. 8A/8B), adjacent to target pin 40A (FIGS. 8A/8B).

Continuing to refer primarily to FIGS. 7D-7F, second work station 70 of exemplary hand tool 50 can perform an assembling operation that can be indicated by operational indicators 113. Exemplary work piece 20A (FIG. 7D), with at least one unengaged exterior linkable unit 35 (FIG. 7D), and exemplary work piece 20B (FIG. 7D) with at least one unengaged interior linkable unit 30 (FIG. 7D), can be received into second repository 73 (FIG. 7D). Pin hole 36

Figure 7I:
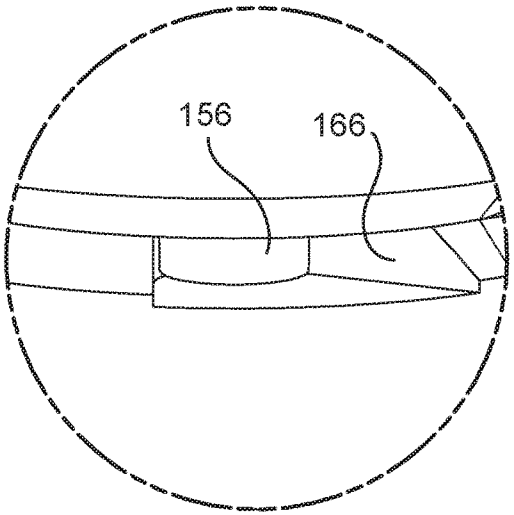
FIG. 7I depicts a detailed view of a raised feature on a second platform received in a pocket of the second door when the second door is in a closed position.

(FIGS. 1A-1D) of at least one unengaged exterior linkable unit 35, pin receptacle 31 (FIGS. 1A-1D) of at least one unengaged interior linkable unit 30 and first opening 77A of second operative channel 77 can be aligned such that an assembling pin (not shown) can be received to engage exemplary work piece 20A and exemplary work piece 20B. Second repository 73 can further comprise alignment features configured to ensure appropriate positioning of exemplary work pieces 20A and 20B therein. A first example of such alignment features can be, but not limited to, first contouring 71, second contouring 72 that can be provided on walls 75 and 76 of second repository 73. Contouring 71, 72 can structurally complement exemplary work pieces 20A and 20B, received therein. Another example of such alignment features can be to provide at least one indent 121 on the second base 78 of the second repository 73, such that the at least one indent 121 can be configured to receive neighboring pins 43 (FIG. 8B), wherein neighboring pins 43 (FIG. 8B), can be adjacent to potential link 41 (FIG. 1C). Potential link 41 (FIG. 1C) can be formed between unengaged exterior linkable unit 35 of work piece 20A and unengaged interior linkable unit 30 of work piece 20B. Disassembling work piece 20 can be retained in the first repository 63 and assembling work pieces 20A, 20B can be retained in second repository 73 when the first door 80 and second door 85 are in a locked position. Above discussed retaining of work pieces, 20, 20A, 20B can be depicted by FIG. 7F Referring now to FIGS. 7G-7I, first door 80 (FIG. 7G) and second door 85 (FIG. 7G) are depicted in a locked position. Locking of first door 80 (FIG. 7G) can cause neighboring pins 43 to be accommodated into pin pockets 123 (FIG. 7G/7H) that can be provided on first door 80 (FIG. 7G). A detailed view is depicted in FIG. 7H. Likewise, locking of second door 85 (FIG. 7G) can cause projections 156 (FIGS. 7G/7I) on second door platform 150 (FIG. 7G) to be retained into pockets 166 (FIGS. 7G/7I) of second door 85. A detailed view of above mentioned engagement is depicted in FIG. 7I. In some configurations, locking of first door 80 (FIG. 7G) and second door 85 (FIG. 7G) can cause a comprising force on body 55 (FIG. 7G) of first exemplary hand tool configuration 50 (FIG. 7G).

Referring now to FIG. 8A, a cross-section of prime body 55 when a disassembling operation is performed at first work station 60 is depicted. An exemplary work piece 20, that is required to undergo a disassembling operation, can be received into the first repository 63 and can be retained therein by configuring first door 80 and second door 85 to be in a locked position i.e. completely rested in first platform 140 (FIG. 4A) and second platform 150 (FIG. 4B), respectively. Disassembling of exemplary work piece 20 can be achieved by withdrawing target pin 42 that can engage at least one exterior linkable unit 35 and at least one interior linkable unit 30. Work piece 20 can be positioned such that target pin 42 (FIG. 8A) is placed at first opening 67A (FIG. 8A) of first operative channel 67. Disassembling operation can further employ manipulator 100 that can comprise a first end that can form part of handle portion 105 and a second end that can form part of pin segment 101. Insert portion 103 of manipulator 100 can be provided between handle portion 105 and pin segment 101. Insert portion 103 can be further configured to enter the first operative channel 67 through a first access window 88A that can be provided on second door 85. Handle portion 105 can be employed by a user to provide external force for inserting pin 40 (FIG. 1A). In some configurations, insert portion 103 can provide male threads that complement with matching female threads on first access window 88A allowing insert portion 103 to be screwed into first operative channel 67, disposition of male and female threads can be reversed. In some configurations, insert portion 103 can be pushed into first operative channel 67. Handle portion 105 can form an angular relationship with insert portion 103 such that user can provide a rotational force to allow insert portion 103 to be screwed into first operative channel 67. In some configurations, handle portion 105 can further comprise gripping features such as, but not limited to, plastic and/or elastic coating that can radially extend along a length of handle portion 105, structural patterns configured to provide consistent contact between handle portion 105 and the user, external tools, or a combination thereof.

Continuing to refer primarily to FIG. 8A, insertion of the insert portion 103 into first operative channel 67 can cause the pin segment 101 to travel through first operative channel 67 and contact target pin 40A (FIGS. 1A-1C) of exemplary work piece 20. In some configurations, first operative channel 67 can be a telescopic path between first opening 67A and second opening 67B (FIG. 4B). Neck 69 can be provided at the first opening 67A. In some configurations, neck 69 can be dimensioned to receive only pin segment 101 of manipulator 100. Length of neck 69 can govern an extent to which insert portion 103 is required to travel through first operative channel 67. The extent can facilitate insert portion 103 to substantially cover first operative channel 67 and further allow pin segment 101 to partially or completely enter pin hole 36 (FIGS. 1A-1D) and pin receptacle 31 (FIGS. 1A-1C) of target pin 42, when operating thereupon. Pin segment 101 can be dimensioned to substantially cover target pin area 39 of target pin 42 such that a contact between the pin segment 101 and target pin 42 can be maintained during the disassembling operation. Pin segment 101 can be further configured to be received into pin hole 36 (FIG. 1A-1D) of exterior linkable unit 35 and pin receptacle 31 (FIGS. 1A-1D) of interior linkable unit, that collectively house target pin 42. Handle portion 105 coupled with pin segment 101 can force the target pin 42 to exit exemplary work piece 20 and causing disassembling thereof. First segment 80A of first door 80 can comprise a pin outlet 180 (FIG. 8B) through which the target pin 42 can be removed out of first work station 60 after completion of the disassembling operation. In some configurations, pin outlet 180 (FIG. 8B) can be sized to dimensionally complement the removed target pin 42.

Figure 8B:
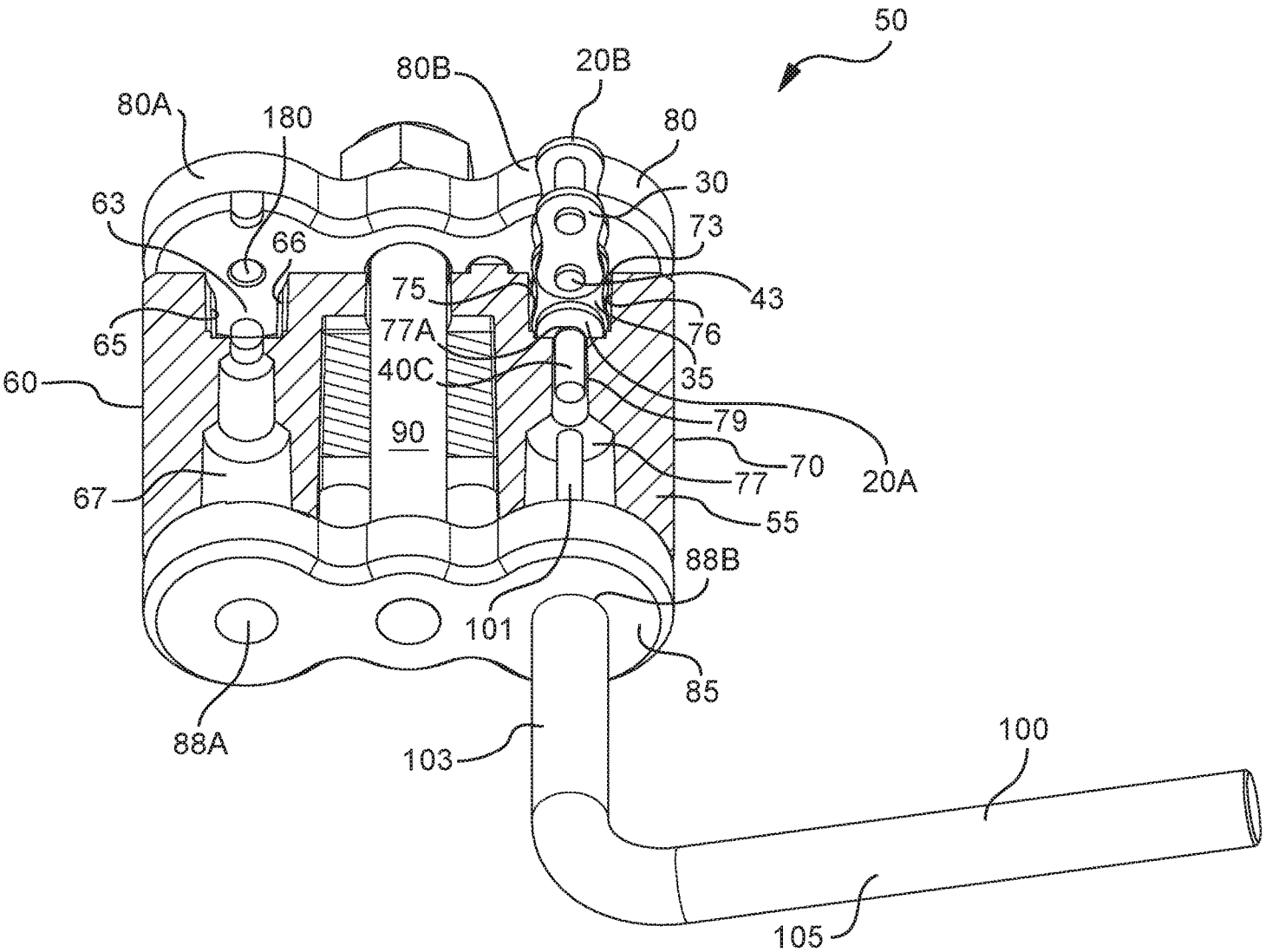

Referring now to FIG. 8B, first exemplary work piece 20A with at least one unengaged exterior linkable unit 35 and a second exemplary work piece 20B with at least one unengaged interior linkable unit 30 can be assembled by receiving an assembling pin 40C into a potential link 41 (FIG. 1C). Potential link 41 (FIG. 1C) can be formed by aligning at least one unengaged exterior linkable unit 35 of first exemplary work piece 20A, at least one unengaged interior linkable unit 30 of second work piece 20B with first opening 77A of second operative channel 77. Assembling pin 40C can be dropped into the second operative channel 77 through second access window 88B that can be provided on second door 85. In some configurations, assembling pin 40C can travel through the second operative channel 77 and reach first opening 77A that can comprise an entry to potential link 41 (FIG. 1C). Proper alignment of assembling pin 40C into first opening 77A, in some configurations, can be achieved using a tapered feature between second operative channel 77 and neck region 79. Consequently, assembling pin 40C can be configured to enter potential link 41 (FIG. 1C).

Continuing to refer to FIG. 8B, second operative channel 77 can further comprise neck region 79. Neck region 79 can be configured to accommodate dropped in assembling pin 40C. Additionally, neck region 79 can be dimensioned such that objects sized similar to assembling pin 40C or smaller can be received therein. In some configurations, the length of neck region 79 can be higher than the length of assembling pin 40C. Manipulator 100 can be inserted into second operative channel 77 after insertion of assembling pin 40C therein. Pin segment 101 of manipulator 100 can be configured to contact assembling pin 40C in the second operative channel 77. A continuous contact can be achieved between pin segment 101 and assembling pin 40C. In some configurations, the surface area of contacting end 40A (FIGS. 1A-1C) and/or 40B (FIGS. 1A-1C) of assembling pin 40C can be larger than the surface area of contacting end (not shown) of pin segment 101. An external force can be applied to insert portion 103 through handle portion 105 of manipulator 100, as a result of which pin segment 101 can drive assembling pin 40C into potential link 41 (FIG. 1C). An external force can be applied until assembling pin 40C is received into pin hole 36 (FIGS. 1A-1D) of at least one unengaged exterior linkable unit 35 (FIGS. 1A-1D) of first work piece 20A and further received into a pin receptacle 31 (FIGS. 1A-1D) of at least one unengaged interior linkable unit 30 of second work piece 20B. Subsequently, assembling pin 40C can partially depart pin receptacle 31 (FIGS. 1A-1D) and enter second pin hole 36 (FIGS. 1A-1D) of another unengaged exterior linkable unit 35 (FIGS. 1A-1D). Such engagement can cause assembling of first work piece 20A and second work piece 20B, aligned together in second repository 73. Second segment 80B of first door 80 can be configured to serve as a barrier to prevent assembling pin 40C to be pushed out of potential link 41 (FIG. 1C). A barrier indent 167 (FIG. 5A) can be provided on second segment 80B of first door 80. Barrier indent 167 (FIG. 5A) can be aligned to receive an end 40A or 40B (FIGS. 1A-1D) of assembling pin 40C and further block assembling pin 40C to be driven beyond a pre-determined position. As a result, second segment 80B and/or barrier indent 167 (FIG. 5A) of second segment 80B can be configured to oppose the external force applied on pin segment 101 such that assembling pin 40C can be pushed only until a desired extent. In some configurations, assembling pin 40C can be pushed until assembling pin 40C is configured to be in a position substantially similar to neighboring pin/s 43 of first work piece 20A and second work piece 20B.

Figure 9A:
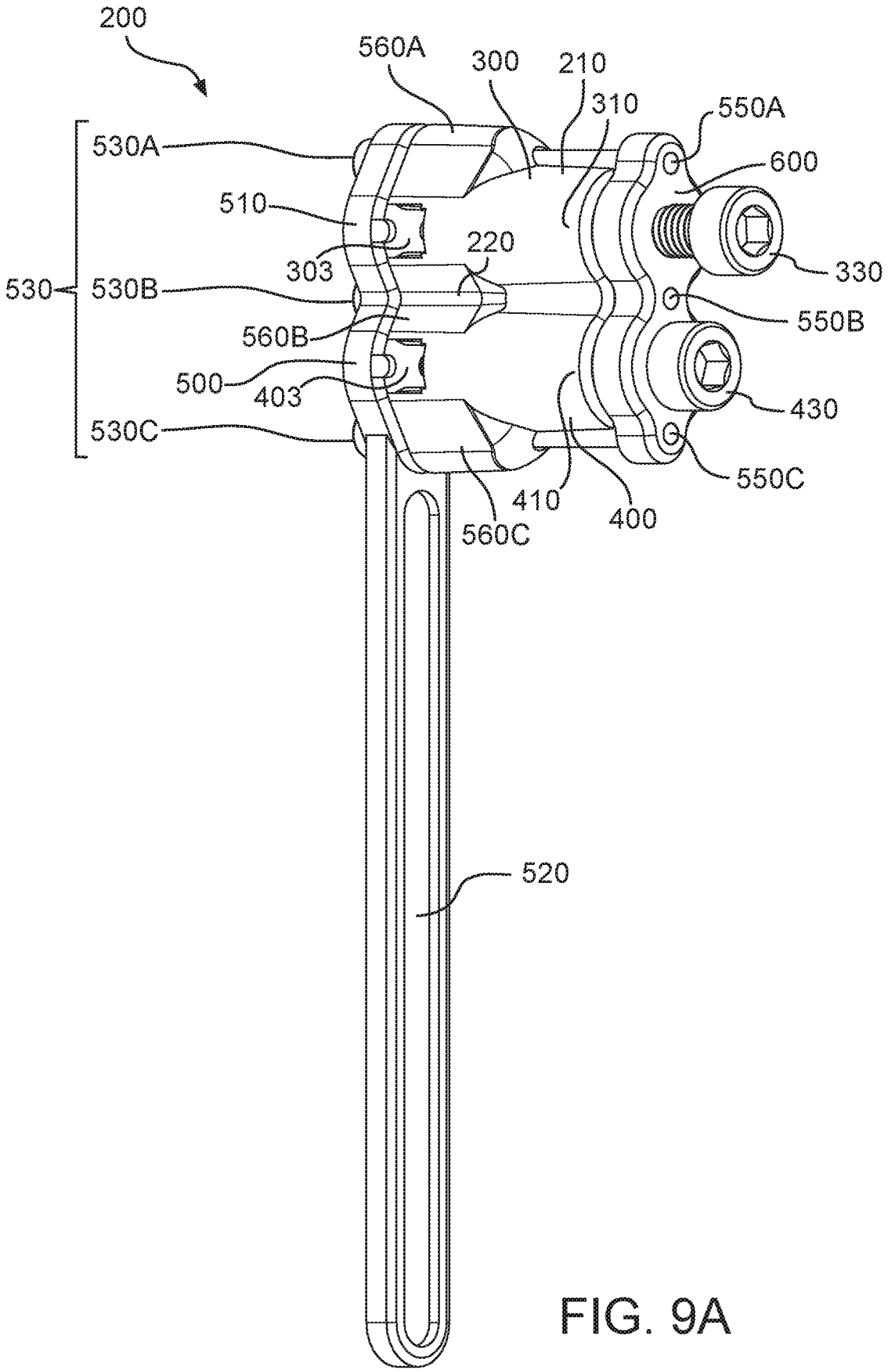
FIGS. 9A-9B depict perspective views of a second hand tool configuration.
Figure 9B:
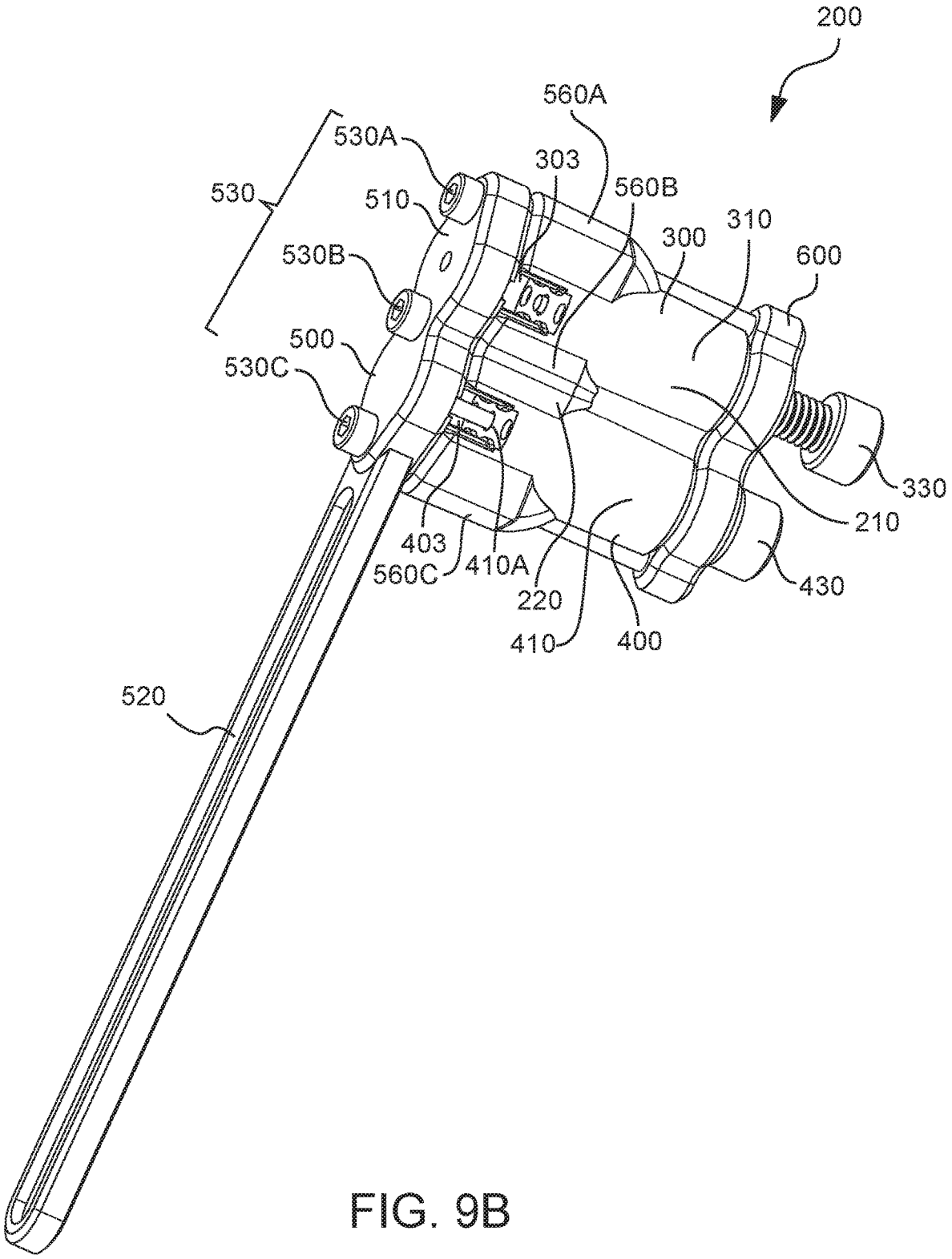
Figure 10:
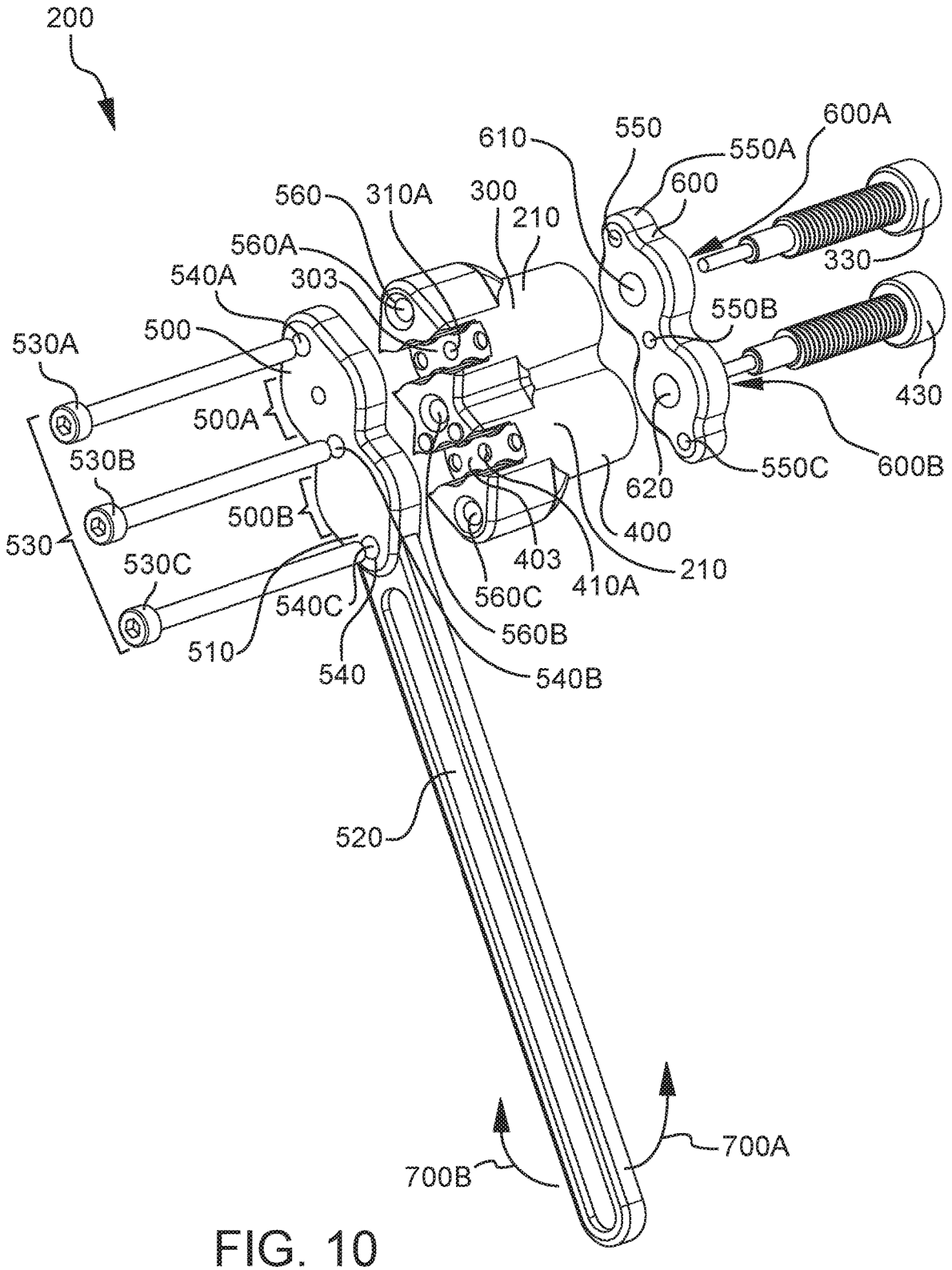
FIG. 10 depicts an exploded view of the second hand tool configuration.

Referring now primarily to FIG. 9A and FIG. 9B, a second hand tool configuration 200 for assembling and disassembling a work piece is depicted. Second hand tool configuration 200 can comprise body 210, first door 500 and second door 600. Body 210 can be divided into first work station 300 and second work station 400 that can be associated by way of a bridging wall 220. The first work station 300 can further include at least one first operative channel 310 while the second work station 400 can further include at least one second operative channel 410. First operative channel 310 can further comprise a first opening 310A (FIG. 10) and second opening 310B (FIG. 11B). Likewise, the second operative channel 410 can also comprise a first opening 410A (FIG. 10) and a second opening 410B (FIG. 11B). In some configurations, at least one disassembling operation can be performed at first work station 300 and at least one assembling operation can be performed at second work station 400. In some configurations, first work station 300 and second work station 400 can serve to perform a disassembling and/or an assembling operation. The assembling and disassembling operations can be performed on an exemplary work piece such as, but not limited to work piece 20 (FIGS. 1A-1D). Second hand tool configuration 200 can also serve to perform assembling and/or disassembling operations on components substantially similar to work piece 20 (FIGS. 1A-1D).

Continuing to refer to FIGS. 9A and 9B, first work station 300 can further comprise a first repository 303 and the second work station 400 can comprise a second repository 403. First and second repositories 303, 403 can be positioned at an entrance of first operative channel 310 and second operative channel 410, respectively. Additionally, first repository 303 and second repository 403 can be configured to receive at least one work piece 20 (FIGS. 1A-1D) on which an assembling and/or a disassembling operation can be performed. Access to first repository 303 and second repository 403 can be managed by first door 500. Two repositories 303, 403 can enable first door 500 to manage access to first operative channel 310 and second operative channel 410. First door 500 can be engaged with body 210 by way of at least one door connector 530. Reference 530 can collectively refer to door connectors 530A, 530B and 530C. The second hand tool configuration 200 can comprise a first door connector 530A, a second door connector 530B and a third door connector 530C to engage first door 500 with body 210.

Continuing to refer to FIG. 9A and FIG. 9B, second door 600 can be configured to manage access to second opening 310B (FIG. 11B) of first operative channel 310 and second opening 410B (FIG. 11B) of second operative channel 410. Second door 600 can further comprise a first access window 610 (FIG. 10) and a second access window 620 (FIG. 10). First access window 610 (FIG. 10) can be configured to provide access to first operative channel 310 and second access window 620 (FIG. 10) can be configured to provide access to the second operative channel 410. Access windows 610 (FIG. 10) and 620 (FIG. 10) can further allow an operative tool to attain entry into the corresponding operative channels 310, 410. Second hand tool configuration 200 can further comprise first manipulator 330 that can serve as an operative tool for first operative channel 310. In some configurations, first manipulator 330 can serve as a disassembling manipulator and can be dedicated to first work station 300. Second hand tool configuration 200 can further comprise second manipulator 430 that can serve as an operative tool for second operative channel 410. Second manipulator 430 can serve as an assembling manipulator and can be dedicated to second work station 400. In some configurations a common manipulator can be used for first work station 300 and second work station 400, and a common manipulator can be configured to perform assembling and disassembling operations in the second hand tool configuration 200. In some configurations, manipulator 100 (FIGS. 3A/3B) of first hand tool configuration 50 (FIGS. 3A/3B) can also be employed for assembling and/or disassembling operations of second hand tool configuration 200.

Referring now to FIG. 10, body 210 of second hand tool configuration 200 can be engaged with first door 500 and second door 600 through connectors 530A, 530B and 530C. The door connectors 530A, 530B and 530C can be collectively referred to using a common reference number 530. First door 500 can comprise a first set of corresponding connector points 540A, 540B and 540C that can receive the respective door connectors 530, therein. The first set of connector points 540A, 540B and 540C can be collectively referred to by reference number 540. Door connectors 530 can be inserted into matching connector pathways 560A, 560B and 560C that can be provided on body 210. The matching connector pathways 560A, 560B and 560C can be collectively referred to by reference number 560. The first set of connector points 540 and connector pathways 560 can enable first door 500 to be engaged with body 210. Second door 600 can further comprise a second set of connector points 550A, 550B and 550C that can receive a remainder of corresponding door connectors 530A, 530B and 530C extending from connector pathways 560A, 560B and 560C. The second set of connector points 550A, 550B and 550C can be collectively referred by a common reference number 550. As a result, the first door 500, body 210 and second door 600 can be engaged.

Continuing to refer to FIG. 10, first door 500 can be configured to displace from a closed position to an open position for allowing at least one work piece 20 (FIGS. 1A-1D) to be received into first repository 303 and/or second repository 403. Closed position of first door 500 can cause first door 500 to restrict access to first repository 303 and/or second repository 403. In some configurations, first segment 500A of first door 500 can be dedicated to first repository 303 and second segment 500B of first door 500 can be dedicated to second repository 403. Closed position of first door 500 can comprise first segment 500A to restrict access to first repository 303 and/or second segment 500B to restrict access to second repository 403. Open position of first door 500 can comprise first segment 500A to allow access to first repository 303 and second segment 500B to allow access to second repository 403. In some configurations, first door 500 can be in an open position by disengaging door connectors 530. In some configurations, first door 500 can be in an open position by disengaging door connector 530A and 530C such that first door 500 can rotatably pivot about door connector 530B. This configuration can allow first door 500 to perform rotational motion in directions 700A or 700B. In some configurations, first door 500 can be in an open position by disengaging door connector 530A and 530B such that first door 500 can rotatably pivot about door connector 530C in direction 700A or 700B. In some configurations, door connectors 530B and 530C can be disengaged, thus allowing first door 500 to rotatably pivot about door connector 530A.

Figure 11A:
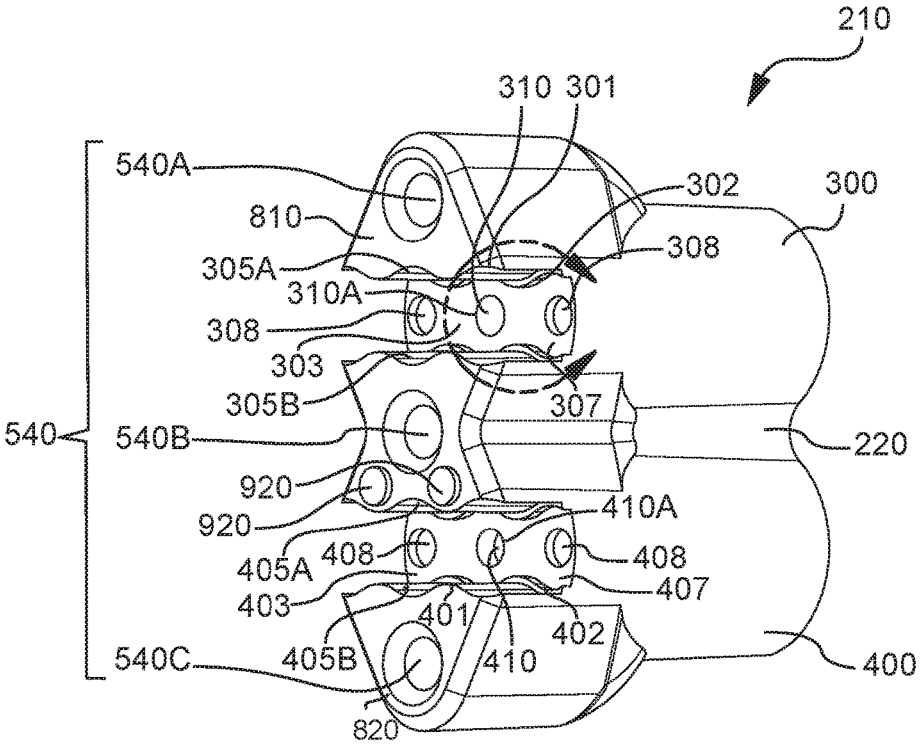
FIGS. 11A-11B depict perspective views of a body of the second hand tool configuration.

Continuing to refer primarily to FIG. 10, first repository 303 can comprise first opening 310A of first operative channel 310 (FIG. 11A) and second repository 403 can comprise first opening 410A of second operative channel 410 (FIG. 11A). First operative channel 310 (FIG. 11A) and second operative channel 410 (FIG. 11A) can further comprise second openings 310B (FIG. 11B) and 410B (FIG. 11B), respectively. Access to second opening 310B (FIG. 11B) of first operative channel 310 (FIG. 11A) and second opening 410B (FIG. 11B) of second operative channel 410 (FIG. 11A) can be managed by second door 600. In some configurations, first segment 600A of second door 600 can be committed to second opening 310B (FIG. 11B) of first operative channel 310 (FIG. 11A) and a second segment 600B of second door 600 can be committed to second opening 410B (FIG. 11B) of second operative channel 410 (FIG. 11A). Second door 600 can further provide first access window 610 and second access window 620. In some configurations, first access window 610 can be dedicated to first operative channel 310 (FIG. 11A) and second access window 620 can be dedicated to second operative channel 410 (FIG. 11A). First access window 610 can be further configured to receive first manipulator 330 such that first manipulator 330 can be inserted into the first operative channel 310 (FIG. 11A) through the first access window 610. Similarly, second access window 620 can be further configured to receive second manipulator 430 such that the second manipulator 430 can be inserted into the second operative channel 410 (FIG. 11A) through the second access window 620.

Figure 11C:
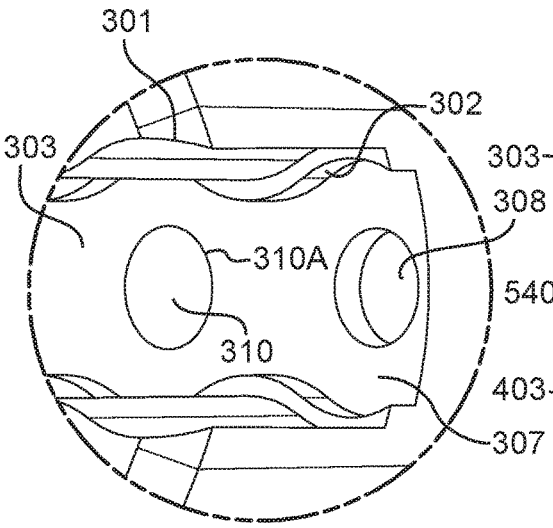
FIG. 11C depicts a detailed view of alignment features on at least one repository of the second hand tool configuration.
Figure 11B:
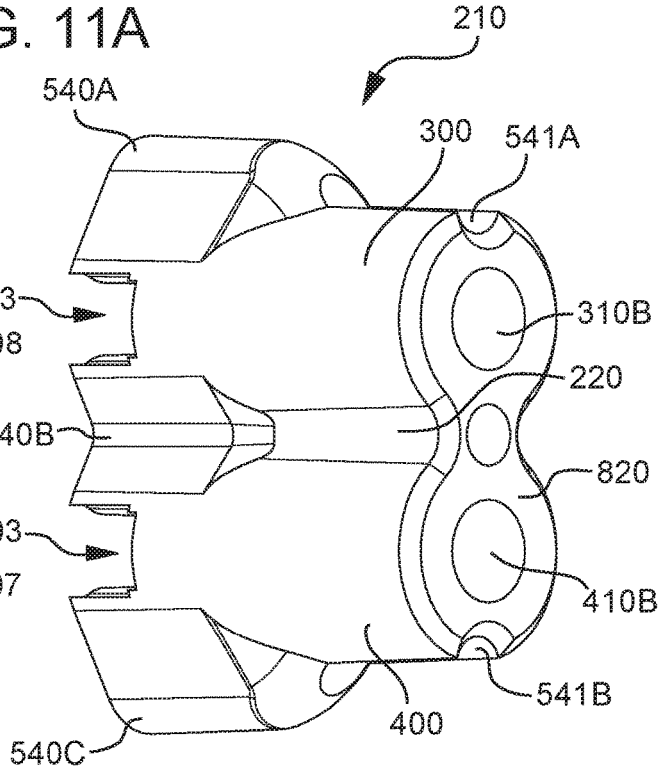

Referring now primarily to FIGS. 11A-11C, body 210 (FIGS. 11A/11B) can comprise first repository 303 that can belong to first work station 300 (FIGS. 11A/11B) and second repository 403 (FIGS. 11A/11B) that can belong to second work station 400. First repository 303 can further comprise a first wall 305A, a second wall 305B and a first base 307. A plurality of alignment features can be provided in first repository 303, to ensure an appropriate placement of at least one work piece 20 (FIGS. 1A-1D) in first repository 303 and/or second repository 403. Alignment features can include, but not limited to, at least one contour that can be provided to first wall 305A and a matching contour that can be provided to second wall 305B, where contour on first wall 305A and matching contour on second wall 305B can be configured to suit work piece/s 20 (FIGS. 1A-1D) that rest in the first repository 303. First repository 303 can comprise first set of contours 301 (FIG. 11A/11C) and second set of contours 302 (FIG. 11A/11C). In some configurations, first set of contour 301 (FIG. 11C can occupy a larger area of walls 305A, 305B (FIG. 11A), compared to area occupied by second set of contour 302 (FIG. 11A/11C). In some configurations, first set of contours 301 (FIG. 11A/11C) can be configured to suit at least one of interior linkable unit 30 (FIGS. 1A-1D) of work piece 20 (FIGS. 1A-1D), whereas second set of contours 302 (FIG. 11A/11C) can be configured to suit at least one exterior linkable unit 35 (FIGS. 1A-1D), thereof. Such an arrangement can cause walls 305A, 305B (FIG. 11A) to be uneven along their respective lengths. In some configurations, the unevenness can be towards base 307 (FIG. 11A/11C) of first repository 303. A detailed view of first set of contours 301 (FIG. 11A/11C) and second set of contours 302 (FIG. 11A/11C) is depicted in FIG. 11C.

Continuing to refer to FIG. 11A-11C, first base 307 (FIG. 11C) of first repository 303 can comprise a first set of indents 308 (FIGS. 11A/11C) that can be configured to receive one or more components of work piece/s 20 (FIGS. 1A-1D) to allow an unobstructed containment of work piece 20 (FIGS. 1A-1D) when an operation is being performed thereupon. The alignment features, such as, but not limited to, contours 301, 302 (FIGS. 11A/11C) and indents 308 (FIGS. 11A/11C), and can enable placement of work piece/s 20 (FIGS. 1A-1D) in first repository 303. In some configurations, neighboring pins 43 (FIG. 14) can be accommodated into corresponding indents 308 (FIGS. 11A/11C). Alignment features, such as, but not limited to contours 301, 302 (FIGS. 11A/11C) and indents 308 (FIGS. 11A/11C) can further facilitate retaining work piece 20 (FIGS. 1A-1D) in more than one configuration. Second repository 403 (FIGS. 11A/11B) can include alignment features for placement of work piece/s 20 (FIGS. 1A-1D) therein. First wall 405A (FIG. 11A) and second wall 405B (FIG. 11A) of second repository 403 (FIGS. 11A/11B) can comprise a first set of contours 401 (FIG. 11A) and second set of contours 402 (FIG. 11A) that can compliment structure and dimensions of work pieces/s 20 (FIGS. 1A-1D), received therein. In some configurations, first set of contours 401 (FIG. 11A) can occupy a larger area of walls 405A, 405B (FIG. 11A), compared to the area occupied by second set of contours 402 (FIG. 11A). In some configurations, first set of contours 401 (FIG. 11A) can be configured to suit at least one of the interior linkable units 30 (FIGS. 1A-1D) of work piece 20 (FIG. 1A-1D), whereas second set of contours 402 (FIG. 11A) can be configured to suit at least one exterior linkable unit 35 (FIGS. 1A-1D), thereof. Such an arrangement can cause walls 405A, 405B (FIG. 11A) to be uneven along their respective lengths. In some configurations, the unevenness can be towards base 407 (FIG. 11A) of second repository 403 (FIG. 11A). A second pair of indents 408 (FIG. 11A) can be provided on base 407 (FIG. 11A) of second repository 403 (FIG. 11A). Second pair of pin indents 408 (FIG. 11A) can be configured to receive at least one component of work piece/s 20 (FIGS. 1A-1D) to enable containment of work pieces 20 (FIGS. 1A-1D) therein. In some configurations, second pair of indents 408 (FIG. 11A) can be configured to receive neighboring pins 43 (FIG. 14) that can be accommodated into corresponding pin indents 408 (FIG. 11A).

Continuing to refer primarily to FIG. 11A and FIG. 11C, body 210 (FIG. 11A) can comprise first platform 810 (FIG. 11A) and a second platform 820 (FIG. 11A). First platform 810 (FIG. 11A) can be configured to allow first door 500 (FIGS. 12A/12B) to rest thereupon and second platform 820 (FIG. 11A) can be configured to allow second door 600 (FIGS. 13A/13B) to rest thereupon. Body 210 can further comprise at least one connector pathway 540 (FIG. 11A) (collectively referring to 540A, 540B, 540C (FIGS. 11A/11B)) that can enable engagement between first door 500 (FIGS. 12A/12B), body 210 and second door 600 (FIGS. 13A/13B). First pathway 540A (FIG. 11B) can be contained in the first work station 300 (FIGS. 11A/11B), second pathway 540C (FIG. 11B) that can be contained in the second work station 400 (FIGS. 11A/11B) and third pathway 540B (FIG. 11B) that can be contained in bridging wall 220 (FIG. 11B) provided between first work station 300 (FIGS. 11A/11B) and second work station 400 (FIGS. 11A/11B). In some configurations, the connector pathways 540 (FIG. 11A) can extend partially or completely along a length of body 210 (FIGS. 11A/11B). In some configurations, connector pathways 540A, 540C (FIG. 11B) can extend partially along a length of first work station 300 (FIGS. 11A/11B) and a length of second work station 400 (FIGS. 11A/11B). In some configurations, the length of each connector pathway 540A, 540B and 540C (FIGS. 11A/11B) can be distinct from each other. Connector grooves 541A, 541B (FIG. 11B) can be provided along remainder of the length of first work station 300 (FIGS. 11A/11B) and second work station 400 (FIGS. 11A/11B), respectively. Connector grooves 541A, 541B (FIG. 11B) can be configured to structurally match corresponding connectors 530A, 530C (FIG. 10).

Figure 12A:
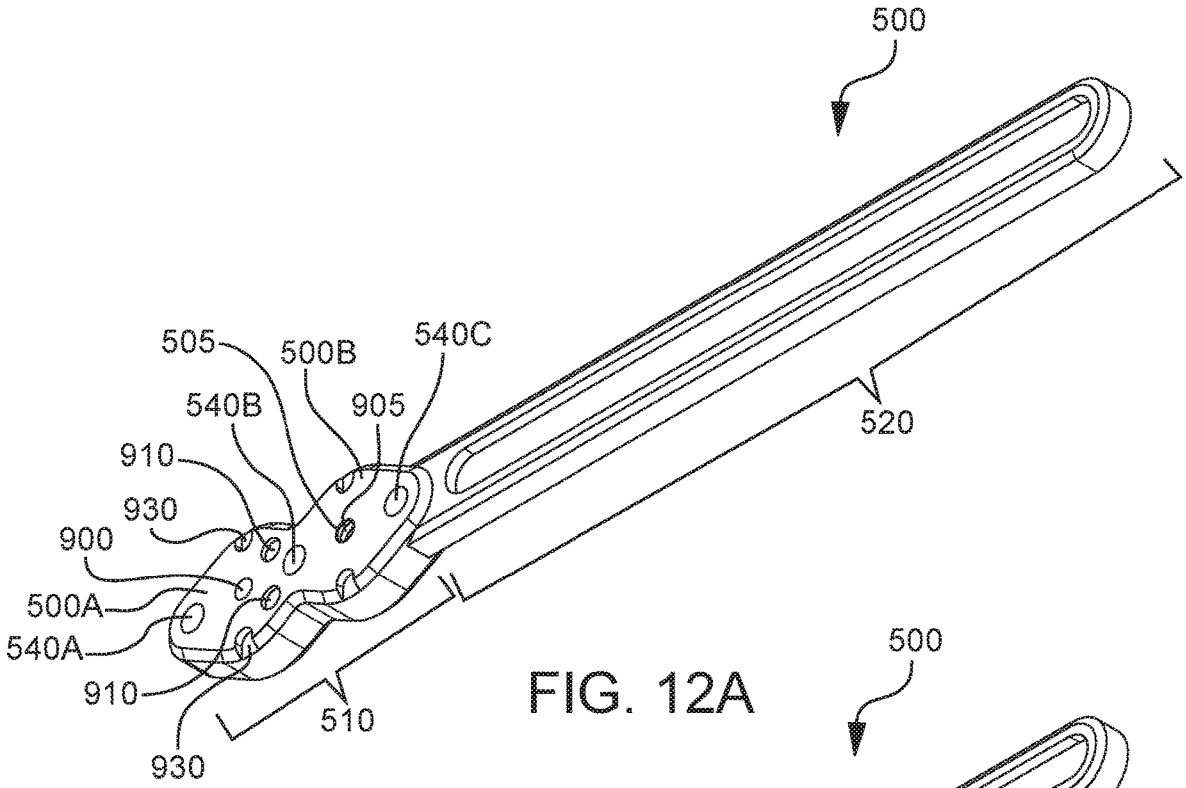
FIGS. 12A-12B depict perspective views of a first door of the second hand tool configuration.
Figure 12B:
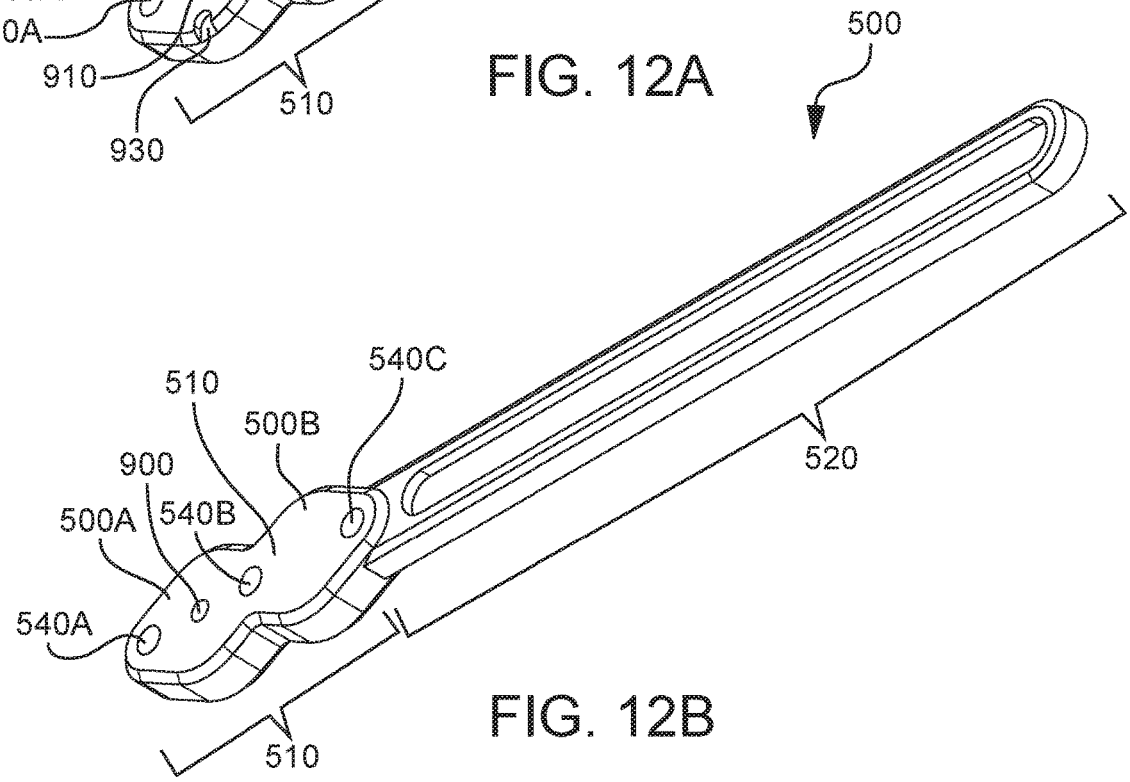
Figure 13A:
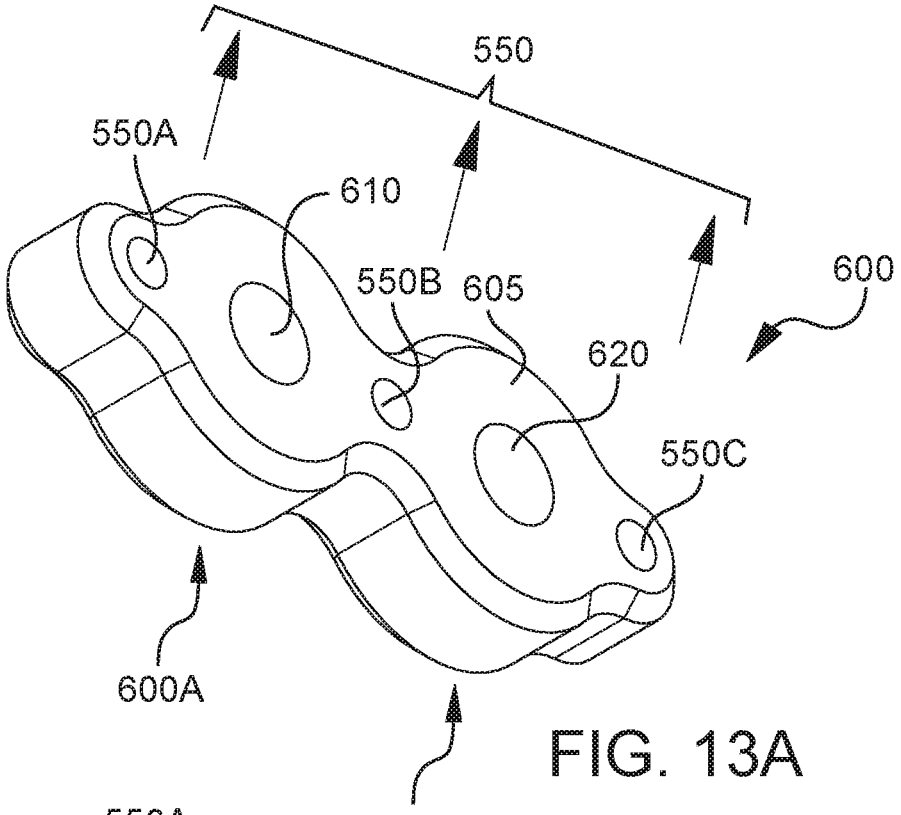
FIGS. 13A-13B depict perspective views of a second door of the second hand tool configuration.
Figure 15A:
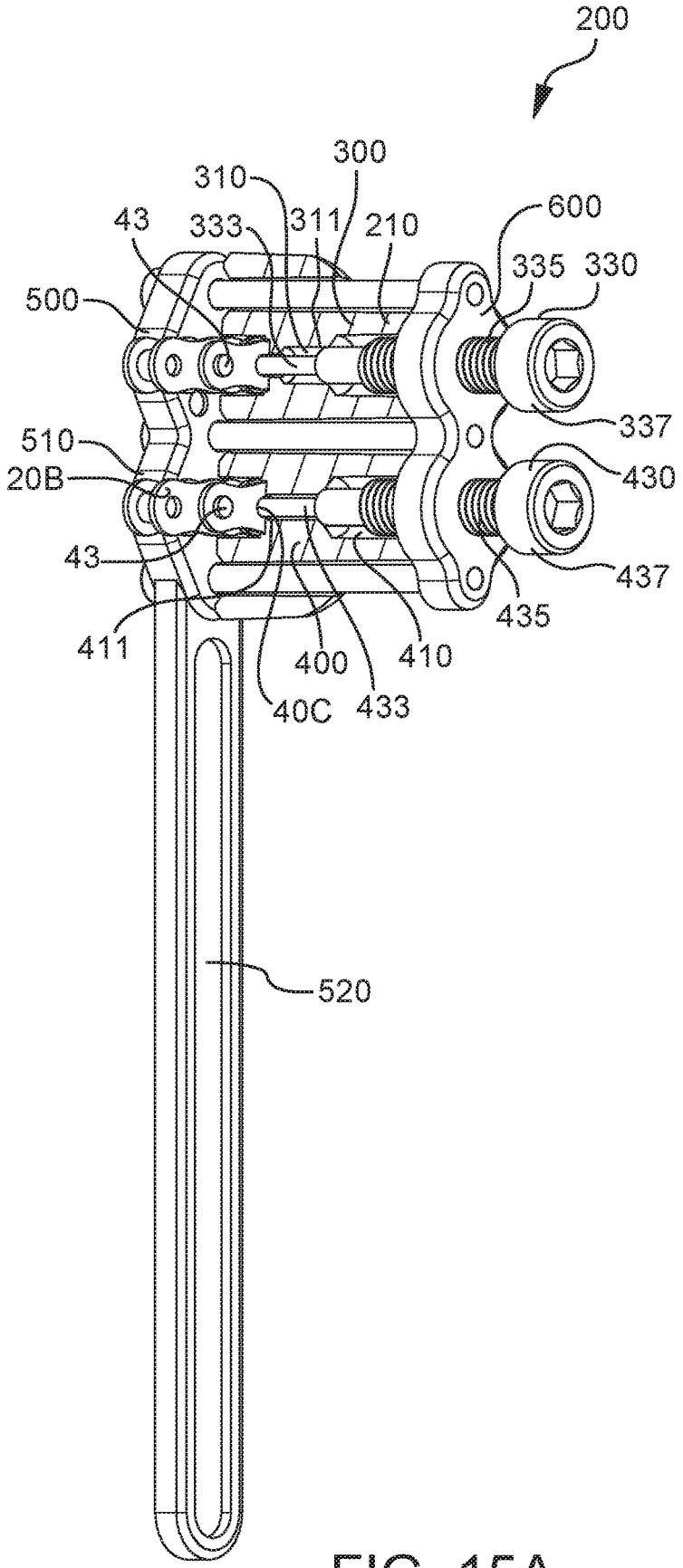
FIGS. 15A-15C depict cross section of the body of the second hand tool configuration during a disassembling and an assembling operation.
Figure 15B:
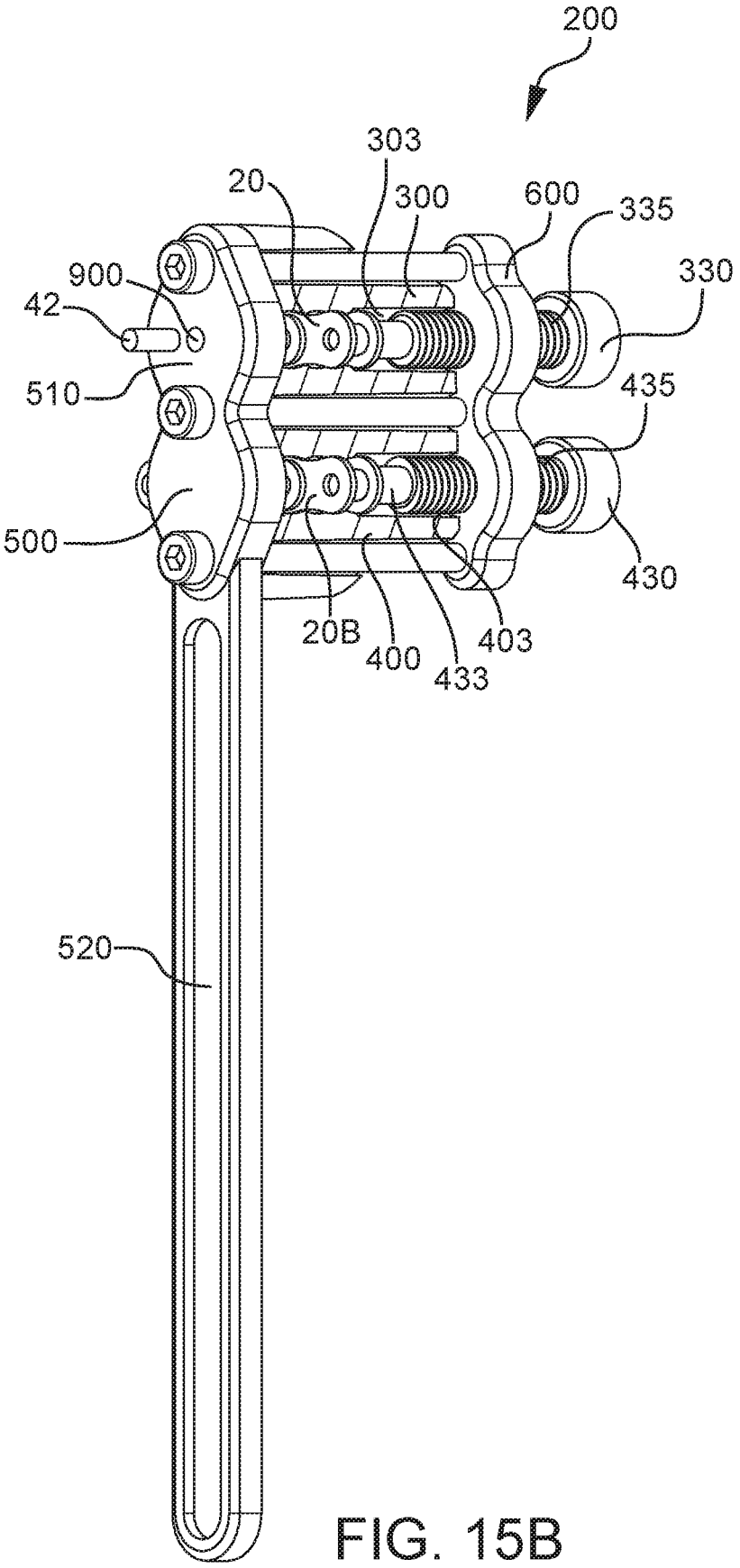
Figure 15C:
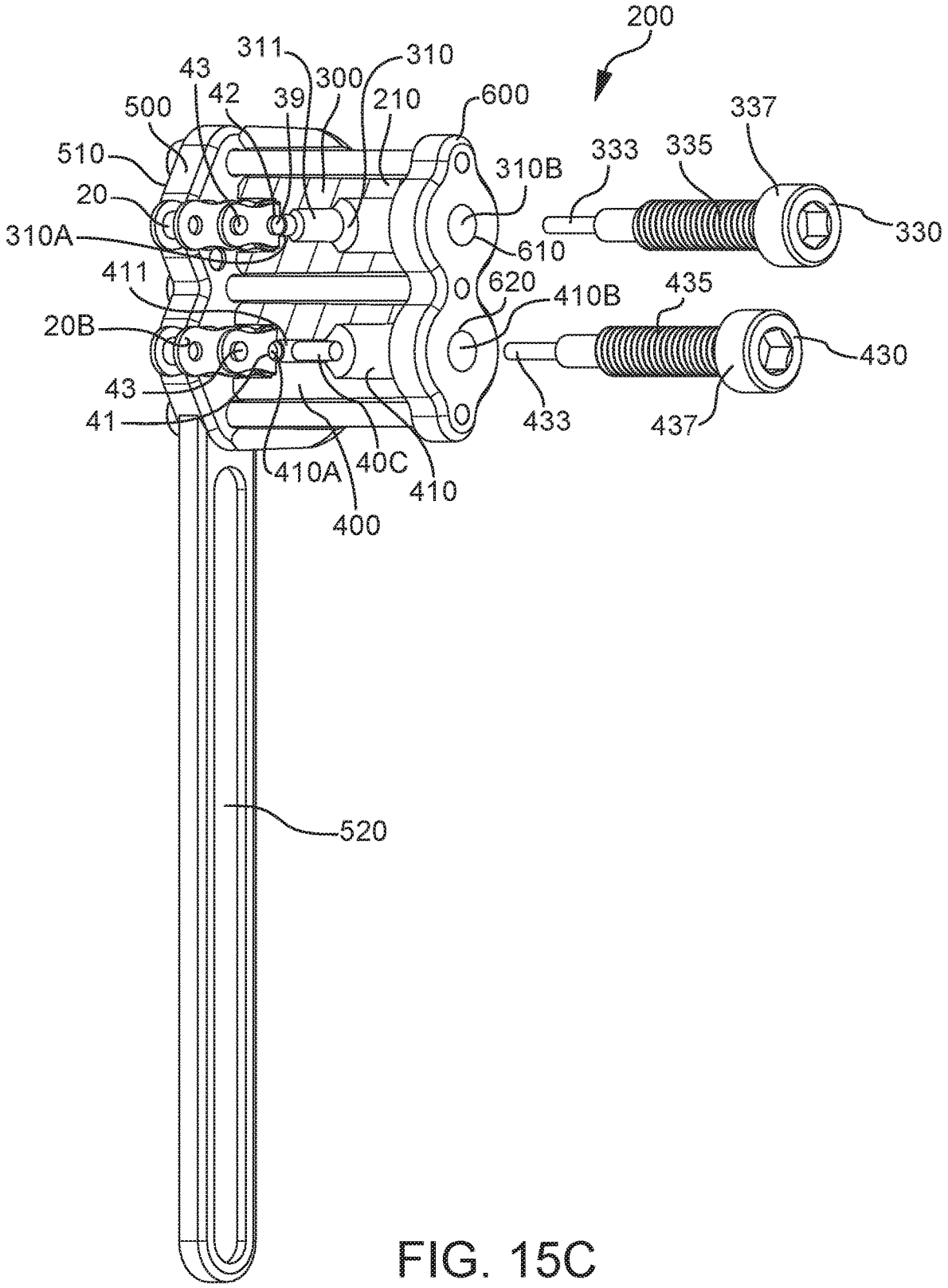

Referring now primarily to FIG. 12A and FIG. 12B, first door 500 can comprise inner first door surface 505 (FIG. 12A) configured to face first repository 303 (FIG. 10) and second repository 403 (FIG. 10) and an outer first door surface 510 (FIG. 12A) opposing inner first door surface 505 (FIG. 12A). First door 500 can be further divided into a door feature 510 that can serve to manage access to repositories 303 (FIGS. 11A-11C), 403 (FIGS. 11A/11B) and handle feature 520 configured to be gripped by a user of second hand tool configuration 200. Engagement between first door 500, body 210 (FIG. 10), and second door 600 (FIG. 10) can be achieved through door connectors 530A, 530B, 530C (FIG. 10) that can be received into a first set of connector points 540A, 540B and 540C provided on first door 500. In some configurations, first segment 500A can be dedicated to first work station 300 (FIG. 10) where a disassembling operation can be performed, and second segment 500B can be dedicated to second work station 400 where an assembling operation can be performed. First door segment 500A can comprise an outlet 900 through which target pin 42 (FIGS. 15A-15C) can be eliminated from first work station 300 (FIG. 10) to cause disassembling of work piece 20 (FIGS. 15A-15C). Second segment 500B of first door 500 can be dedicated to second work station 400 (FIG. 10) where at least one assembling operation can be performed. An assembling pin 40C (FIGS. 15A-15C) can be positioned and blocked from travel beyond a desired point by employing barrier 905 (FIG. 12A) on second segment 500B of first door 500. Barrier 905 (FIG. 12A) can retain assembling pin 40C (FIGS. 15A-15C) in second work station 400 (FIG. 10).

Continuing to refer primarily to FIG. 12A and FIG. 12B, locking of first door 500 can be enabled by way of at least one locking feature. In some configurations, the locking features can include, but are not limited to including, locking indents 910 (FIG. 12A) that can be configured to receive matching raised features 920 (FIG. 11A) of first platform 810 (FIG. 11A) on body 210 (FIG. 11A). Engagement between raised features 920 (FIG. 11A) and locking indents 910 (FIG. 12A) can engage first door 500 during performance of an operation at first work station 300 (FIG. 10) and/or second work station 400 (FIG. 10). First door 500 can comprise alignment features to ensure appropriate configuration of work piece 20 (FIGS. 1A-1D) in the first repository 303 (FIG. 10) and or second repository 403 (FIG. 10). In some configurations, the alignment feature can include, but is not limited to including, alignment pockets 930 (FIG. 12A) that can be configured to allow neighboring pins 43 (FIGS. 15A-15C) to rest therein when first door 500 is in a locked position.

Figure 13B:
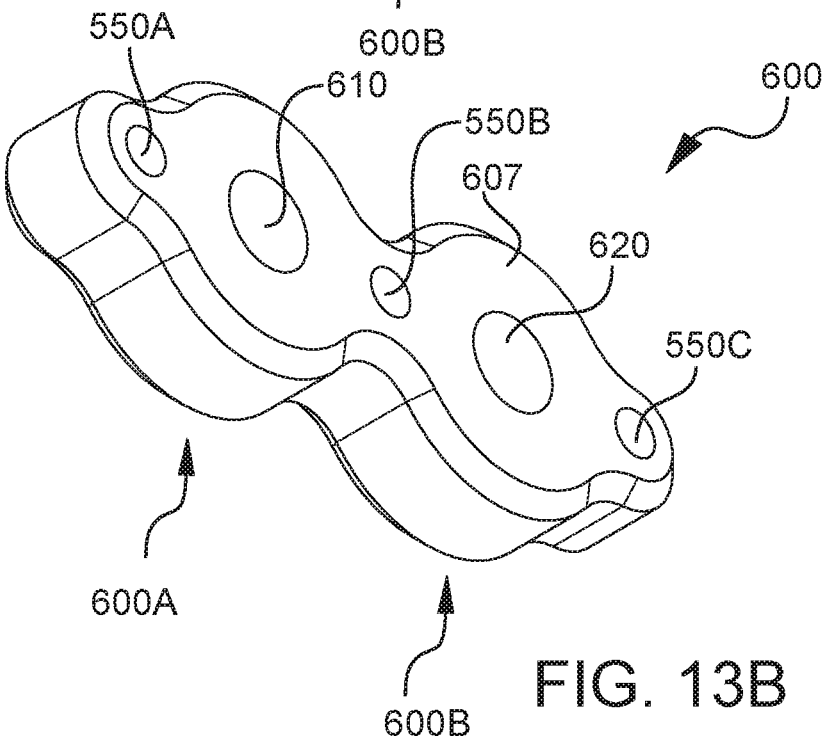

Referring now primarily to FIG. 13A and FIG. 13B, second door 600 can include inner surface 605 (FIG. 13A) that can face second platform 820 (FIGS. 11A-11B) of body 210 (FIGS. 11A-11B) and outer surface 607 (FIG. 13B) opposing inner surface 605 (FIG. 13A). Engagement of second door 600 with body 210 (FIG. 10) and first door 500 (FIGS. 12A/12B) can be achieved by door connectors 530 (FIG. 10) that can be received in a second set of connector points 550 (FIG. 13A), collectively referring to connector points 550A, 550B, 550C. Second door 600 can comprise connector points 550A, 550B and 550C wherein corresponding connectors 530A (FIG. 10), 530B (FIG. 10) and 530C (FIG. 10) can be received. Second door 600 can be divided into first door segment 600A and second door segment 600B. In some configurations, first door segment 600A can be dedicated to first work station 300 (FIG. 10) and second door segment 600B can be dedicated to second work station 400 (FIG. 10). First door segment 600A can comprise a first access window 610 while the second door segment 600B can comprise a second access window 620. First access window 610 and second access window 620 can be configured to manage access to first operative channel 310 (FIGS. 15A-15C) and second operative channel 410 (FIGS. 15A-15C) respectively. In some configurations, first access window 610 and second access window 620 can comprise female threads that match male threads of corresponding incoming manipulators 330, 430 (FIG. 10). Manipulators 330, 430 (FIG. 10) can access first operative channel 310 (FIGS. 15A-15C) and second operative channel 410 (FIGS. 15A-15C) through first access window 610 and second access window 620, respectively.

Figure 14:
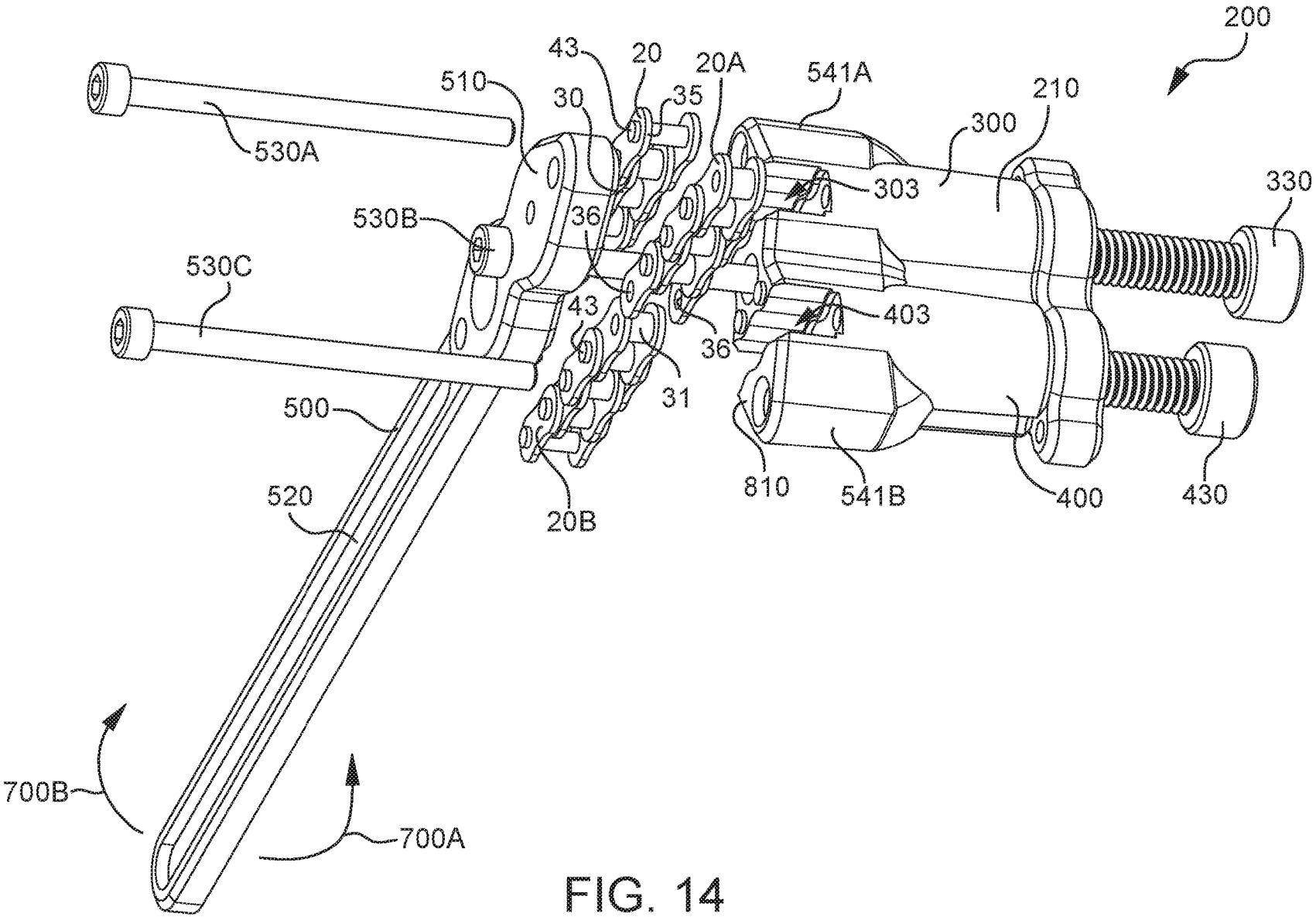
FIG. 14 depicts a perspective view of the second hand tool configuration with the first door in an open position.

Referring now to FIG. 14, first door 500 can be configured to shift into an open position to provide access to first repository 303 and/or second repository 403. At least one exemplary work piece 20 can be received into first repository 303 and/or second repository 403 for performing an operation thereupon. Operations can include, but are not limited to including, assembling and disassembling of work piece/s 20. Open position of first door 500 can be achieved by partially or completely disengaging first door 500 from body 210, thereby allowing first door 500 to rotatably pivot in direction 700A and or 700B. This pivoting motion can be performed by applying an external torque to handle portion 520 of first door 500. Displacing into an open position can cause first door 500 to move from resting on first platform 810 of body 210. Open position of first door 500 can allow first repository 303 and/or second repository 403 to receive at least one exemplary work piece 20.

Continuing to refer to FIG. 14, first repository 303 can receive at least one exemplary work piece 20 on which a disassembling operation can be performed. Exemplary work piece 20 can comprise target pin 42 (FIG. 15C) that can be withdrawn from between an exterior linkable unit 35 and an interior linkable unit 30 of exemplary work piece 20. Second repository 403 can receive at least one work piece 20A with an unengaged exterior linkable unit 35 and at least one other work piece 20B with an unengaged interior linkable unit 30. The two work pieces 20A and 20B can be aligned in second repository 403, such that pin hole 36 of at least one unengaged exterior linkable unit 35 can align with a pin receptacle 31 of at least one unengaged interior linkable unit 30. Alignment can form potential link 41 (FIG. 15A) wherein assembling pin 40C (FIG. 15A) can be received. When work pieces 20, 20A, 20B are appropriately received in their respective repositories 303, 403, first door 500 can be displaced back into a closed position to secure the work piece/s 20, 20A, 20B, therein. First door 500 can be displaced into closed position by applying a torque in direction 700A or 700B such that the first door completely rests on first platform 810 of body 210.

Referring now to FIGS. 15A-15C, first manipulator 330 can be configured to access first operative channel 310, when inserted therein through first access window 610. In some configurations, an external tool such as, but not limited to a wrench tool, can be employed to drive first manipulator 330 into first operative channel 310. In some configurations, external tool that can be dimensioned to suit first operative channel 310, can optionally replace first manipulator 330. Insertion of first manipulator 330 can cause first pin segment 333 thereof to contact target pin 42 that can be aligned with first opening 310A of first operative channel 310. In some configurations, first operative channel 310 can be a telescopic path between first opening 310A and second opening 310B. Neck region 311 can be provided at first opening 67A. In some configurations, neck region 311 can be dimensioned to receive pin segment 333 of manipulator 330. Length of neck region 311 can govern an extent to which insert portion 335 can travel through first operative channel 310. The extent can facilitate insert portion 335 to substantially cover first operative channel 310 and further allow pin segment 333 to partially or completely enter pin hole 36 (FIGS. 1A-1D) and pin receptacle 31 (FIGS. 1A-1C) of target pin 42 when operating thereupon. A user of second hand tool configuration 200 can apply an external force to progressively screw in or slide in first manipulator 330 into first operative channel 310. As a result of the external force, first manipulator 330 can displace target pin 42 from its position, subsequently removing it from work piece 20 to achieve disassembly of work piece 20. Target pin 42 can be removed from first work station 300 through outlet 900 (FIG. 15C) that can be provided on first door 500. In some configurations, first manipulator 330 can be configured to enter first operative channel 310 until target pin 42 is removed and/or disassembling of work piece 20 is achieved.

Continuing to refer to FIGS. 15A-15C, at least one assembling operation can be performed at second work station 400. First work piece 20A with at least one unengaged exterior linkable unit 35 and second work piece 20B with at least one unengaged interior linkable unit 30 (FIG. 14) can be aligned in second repository 403 to form potential link 41 (FIG. 15A). Potential link 41 (FIG. 15A) can be positioned at first opening 410A of second operative channel 410. Assembling pin 40C can be dropped into second operative channel 410 such that assembling pin 40C can travel through second operative channel 410 and reach first opening 410A.

Continuing to refer primarily to FIGS. 15A-15C, second manipulator 430 can be configured to access second operative channel 410, when inserted therein through second access window 620. Insertion of second manipulator 430 can cause second pin segment 433 to contact assembling pin 40C and drop into second operative channel 410. Second operative channel 410 can further comprise neck region 411. Neck region 411 can be configured to accommodate dropped in assembling pin 40C. Neck region 411 can be dimensioned such that objects sized similar to assembling pin 40C or smaller can be received therein. In some configurations, the length of neck region 411 can be longer than the length of assembling pin 40C. A user of second hand tool configuration 200 can apply an external force to progressively screw in or slide in second manipulator 430 into second operative channel 410. Pin segment 433 can be received partially or completely into neck region 411, thereby contacting assembling pin 40C and driving assembling pin 40C into potential link 41. A continuous contact can be achieved between pin segment 433 and assembling pin 40C. In some configurations, the surface area of contacting end 40A (FIG. 1A) and/or 40B (FIG. 1A) of assembling pin 40C can be larger than the surface area of the contacting end (not shown) of pin segment 433. An external force can be applied to insert portion 435 through handle or head portion 337/437 of manipulator 330/430, as a result of which pin segment 433 can drive assembling pin 40C into potential link 41 (FIG. 1C). A user can apply external force until the assembling pin 40C is received into pin hole 36 (FIG. 1A-1D) of at least one unengaged exterior linkable unit 35 (FIGS. 1A-1D) of first work piece 20A (FIG. 14) and further received into a pin receptacle 31 (FIGS. 1A-1D) of at least one unengaged interior linkable unit 30 of second work piece 20B. Subsequently, assembling pin 40C can partially depart pin receptacle 31 (FIGS. 1A-1D) and enter a second pin hole 36 (FIGS. 1A-1D) of another unengaged exterior linkable unit 35 (FIGS. 1A-1D). Configuration of assembling pin 40C in potential link 41 can be similar to configuration of neighboring pins 43. Barrier 905 (FIGS. 12A/12B) can be provided on first door 500 to allow a user to drive assembling pin 40C up to a desired point. Second manipulator 430 can be restricted from driving assembling pin 40C beyond the desired point, even when an external force is applied.

While the present teachings have been described above in terms of specific configurations, it is to be understood that they are not limited to these disclosed configurations. Many modifications and other configurations will come to mind to those skilled in the art to which this pertains, and which are intended to be and are covered by both this disclosure and the appended claims. It is intended that the scope of the present teachings should be determined by proper interpretation and construction of the appended claims and their legal equivalents, as understood by those of skill in the art relying upon the disclosure in this specification and the attached drawings.

What is claimed is:

1. A hand tool for modifying a work piece, the work piece having at least one pin receptacle, the work piece having an interior link and an exterior link, the work piece having at least one pin, the at least one pin having a first shape, the at least one pin operably coupling the interior link with the exterior link, the hand tool comprising:

at least one repository cradling the work piece, the at least one repository having two opposing sides, a base, and an opposing opening opposing the base;

at least one channel housing including the at least one repository, the at least one channel housing having a length, the at least one channel housing including at least one channel, the at least one channel having a second shape and enabling access to the work piece at the base, the at least one channel housing having a first housing end and a second housing end, the first housing end opposing the second housing end, the first housing end including the opposing opening;

at least one door having a first side and a second side, the first side facing the at least one repository and the first housing end, the second side opposing the first side, the at least one door being rotatably mounted proximal to the at least one repository, rotating the at least one door placing the first side across the opposing opening, locking the work in the at least one repository between the first side and the base, the at least one door having at least one blind aperture; and at least one manipulator having a first end and a second end, the first end having an insert portion resting adjacent to the at least one pin when the work piece is locked in the at least one repository, the insert portion being disposed in a first channel of the at least one channel, the second end being configured to be actuated by a user to urge the insert portion against the at least one pin through the first channel of the at least one channel, into the work piece, and against the blind aperture, modifying the work piece.

2. The hand tool as in claim 1 wherein the at least one door comprises:

at least one outlet aligned with a second channel of the at least one channel and extending through the at least one door from the first side to the second side, the at least one outlet being shaped according to the first shape, the at least one manipulator enabling pushing the at least one pin through the at least one outlet to the second side, separating the interior link from the exterior link.

3. The hand tool as in claim 2 wherein the at least one door comprises:

a first segment including the at least one outlet, the first segment being coupled with a first repository of the at least one repository; and a second segment including the at least one blind aperture, the second segment being coupled with a second repository of the at least one repository, wherein the at least one door rotatably covering the first repository and the second repository.

4. The hand tool as in claim 3 further comprising:

a common junction between the first segment and the second segment, the common junction including a connector hole;

a first door of the at least one door and a second door of the at least one door, the first door rotatably coupled with the first housing end, the second door rotatably coupled with the second housing end;

a connector extending the length of the at least one channel housing, the connector rotatably coupling the first door with the second door.

5. The hand tool as in claim 1 wherein the first end comprises threading.

6. The hand tool as in claim 1 further comprising:

at least one retaining feature retaining the at least one work piece in the at least one repository, the at least one retaining feature accommodating at least one protrusion on the work piece, the at least one retaining feature including at least one contour and at least one pin indent, the at least one contour accommodating the interior links and the exterior links.

7. The hand tool as in claim 6 further comprising:

at least one projection extending from the second housing end; and at least one projection receiver on a second door of the at least one door, the at least one projection receiver receiving the at least one projection, preventing the second door from rotating beyond a desired extent.

8. A hand tool for assembling and disassembling at least one work piece comprises:

a body divided into a first work station and a second work station, the first work station and the second work station operably coupled by a bridging wall, the first work station including at least one first operative channel, the second work station including at least one second operative channel, the first operative channel including a first operative channel first opening and a first operative channel second opening, the second operative channel including a second operative channel first opening and a second operative channel second opening; and a second door rotatably simultaneously covering the first operative channel first opening and the second operative channel first opening;

a first door rotatably simultaneously covering the first operative channel second opening and the second operative channel second opening;

a connector positioned in the bridging wall, the connector operably coupling the second door, the body, and the first door, the connector enabling rotation of the first door and the second door; and at least one manipulator having a first end and a second end, the first end having an insert portion resting adjacent to at least one pin of the at least one work piece, the insert portion being shaped to accommodate the first operative channel first opening and the second operative channel first opening, the second end being configured to move the at least one pin with respect to the work piece, one of the at least one manipulators performing the at least one disassembling operation by engaging the at least one pin with the insert portion at the second channel second opening, and moving the at least one pin through the work piece and through a through-hole in the first door in the second workstation, and another of the at least one manipulators performing the at least one assembling operation by engaging the at least one pin with the insert portion at the first operative channel first opening, moving the at least one pin through the first operative channel first opening, moving the at least one pin through the first operative channel, moving the at least one pin into the work piece and against a blind hold in the first door at the first operative channel second opening in the first work station.

9. The hand tool as in claim 8 further comprising:

a first repository shaped to accept the at least one work piece, the first repository of the first work station being positioned at the first operative channel second opening;

a second repository shaped to accept the at least one work piece, the second repository of the second work station being positioned at the second operative channel second opening, wherein the first repository and the second repository each configured to receive the at least one work piece, and wherein the second door including a first access window and a second access window, the first access window providing access to the first operative channel, the second access window providing access to the second operative channel, the first access window and the second access window admitting the at least one manipulator into the first operative channel and the second operative channel, respectively.

* * * * *